US011014059B2

(12) United States Patent
Sun et al.

(10) Patent No.: US 11,014,059 B2
(45) Date of Patent: May 25, 2021

(54) BLADED LIQUID AGITATOR

(71) Applicant: Shanghai Bai Ge Home Goods Co., Ltd., Shanghai (CN)

(72) Inventors: Yuguang Sun, Shanghai (CN); Zhitao Wang, Buffalo Grove, IL (US)

(73) Assignee: Shanghai Bae Ge Home Goods Co., Ltd., Shanghai (CN)

( * ) Notice: Subject to any disclaimer, the term of this patent is extended or adjusted under 35 U.S.C. 154(b) by 0 days.

(21) Appl. No.: 16/599,811

(22) Filed: Oct. 11, 2019

(65) Prior Publication Data

US 2020/0038823 A1 Feb. 6, 2020

Related U.S. Application Data

(63) Continuation-in-part of application No. 15/401,709, filed on Jan. 9, 2017, now abandoned.

(30) Foreign Application Priority Data

Aug. 31, 2016 (CN) ..... 201610788807.05

(51) Int. Cl.
*B01F 13/00* (2006.01)
*B01F 15/00* (2006.01)

(52) U.S. Cl.
CPC ..... *B01F 13/005* (2013.01); *B01F 13/0022* (2013.01); *B01F 15/00512* (2013.01); *B01F 2215/0022* (2013.01)

(58) Field of Classification Search
CPC ..... B01F 13/005; B01F 13/0022; B01F 15/00512; B01F 2215/0022
See application file for complete search history.

(56) References Cited

U.S. PATENT DOCUMENTS 3,244,408 A * 4/1966 Brownlie ..... B01F 7/041 366/300
3,969,446 A 7/1976 Franklin, Jr.
4,240,905 A 12/1980 Scaccia
5,607,235 A * 3/1997 Campbell ..... B01F 7/00908 366/147

(Continued)

FOREIGN PATENT DOCUMENTS

CN 204672240 U 9/2015
DE 102006060260 A1 6/2008

(Continued)

OTHER PUBLICATIONS

Product sheet for Popeye's Supplements Shaker Cup, retrieved on Feb. 26, 2016 (3 pages), [http://www.supplementscanada.com/gear-typhoon-shaker-ball-blue.html].

(Continued)

*Primary Examiner* — Anshu Bhatia
(74) *Attorney, Agent, or Firm* — Nixon Peabody LLP

(57) ABSTRACT

A physically independent agitator for insertion in a liquid container is disclosed. An example agitator includes a central body having sufficient density to be immersed in the liquid in the container. The agitator includes a plurality of blades supported by the body. Each of the blades has a proximal end attached to the body, and an outer edge having a triangular cross section. The blades are propelled by the liquid to cause the agitator to spin when the container is shaken.

18 Claims, 17 Drawing Sheets

(56) References Cited

U.S. PATENT DOCUMENTS

| | | | | |
|---|---|---|---|---|
| 6,032,931 | A | 3/2000 | Plunkett | |
| 6,095,676 | A * | 8/2000 | Kuan | B01F 7/26 366/256 |
| 6,379,032 | B1 | 4/2002 | Sorensen | |
| D736,599 | S | 8/2015 | Enghard | |
| 2004/0047231 | A1 | 3/2004 | Coll | |
| 2004/0228210 | A1 * | 11/2004 | Himmelsbach | B01F 7/00275 366/330.3 |
| 2014/0233344 | A1 | 8/2014 | Aliberti | |
| 2016/0287020 | A1 | 10/2016 | Horito | |

FOREIGN PATENT DOCUMENTS

| | | | |
|---|---|---|---|
| DE | 102013017310 | A1 | 1/2015 |
| DE | 202015104837 | U1 | 10/2015 |

OTHER PUBLICATIONS

Product sheet for GNC Pro Performance 28 oz JAXX Shaker Cup, retrieved on Feb. 22, 2016 (2 pages), [http://www.gnc.com/GNC-Pro-Performance-28oz-JAXX-Shaker-Cup/product.jsp?productId=17370346].

Product sheet for Shaker Cup Protein Blender Mixer Water Bottle, retrieved on Feb. 23, 2016 (2 pages), [http://guide.alibaba.com/shop/shake-shaker-cup-protein-blender-mixer-water-bottle-whisk-ball-700ml_3180329.html].

Product sheet for Rubbermaid Shaker Bottle, retrieved on Feb. 22, 2016 (6 pages), [https://jazzrunner.wordpress.com/2015/12/09/shake-shake-shake-rubbermaid-shaker-bottle].

* cited by examiner

BLADED LIQUID AGITATOR

PRIORITY CLAIM

This application is a continuation in part application of U.S. application Ser. No. 15/401,709, filed Jan. 9, 2017, that application claims priority from Chinese Application No. 201610788807.05 filed Aug. 31, 2016. Both of those applications are hereby incorporated by reference in their entirety.

TECHNICAL FIELD

This disclosure relates to an agitator for a liquid container and more specifically to a bladed agitator that is spun by shaking the container to cause the liquid to propel the blades and thereby agitate the liquid.

BACKGROUND

Liquid containers such as water bottles are often used for powdered compositions such as dietary supplements, drink mixes, and baby formulas. For example, water may be poured into the water bottle and such substances may be added to the water. Such substances are mixed with the water to form a composition. Other substances such as salad dressings, soups, etc. may be combined by such a process. The powdered composition often clumps forming aggregations of powder surrounded by a thick layer of paste that inhibits liquid from penetrating into the clump. These clumps may float, sink to the bottom of the container, or remain suspended at some level in the fluid. Powder may also stick to the sides or bottom of a container and resist mixing by simple shaking. One solution is to use a stirrer to mix the powder with the liquid. However, such a mechanism requires the user to keep the bottle open to stir the liquid. This process may be inconvenient and may have to be repeated if the mixed liquid is not immediately consumed as the clumps may reform or the substances may separate from the liquid.

Another solution is the insertion of an agitator that is sealed with the liquid in the bottle. The agitator allows a user to shake the bottle and results in dispersion of clumps and aggregations on the container walls as the agitator moves in the liquid. However, current agitators suffer from the fact that a user must continue to shake the bottle to keep the agitator functioning to disperse the powder in the liquid. The requirement for continuous shaking of the bottle is burdensome to the user.

Thus, there is a need for an agitator that may be inserted in a liquid container and allows agitation of liquid and additives by shaking a bottle. There is a further need for an agitator that remains orientated in one position relative to the liquid level. There is a further need for an agitator that has dynamic movement independent of attachment to a liquid container. There is also a need for an agitator that maintains the agitation motion even after a liquid bottle has stopped being shaken.

BRIEF SUMMARY

One disclosed example is

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1A:
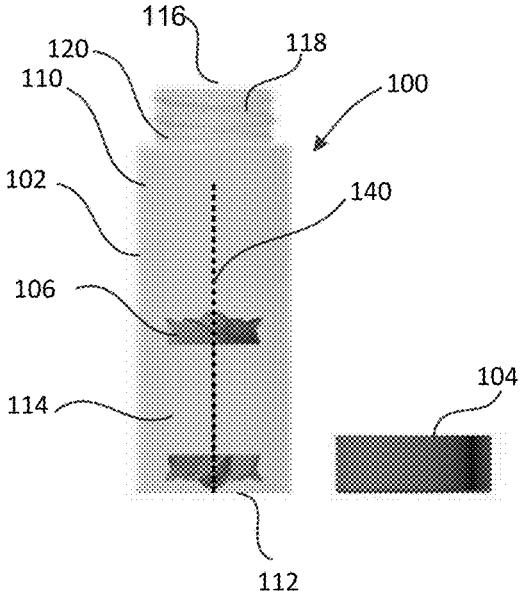
FIG. 1A is a side view of a liquid container with an example of a dual propeller agitator inserted in the container.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Figure 1B:
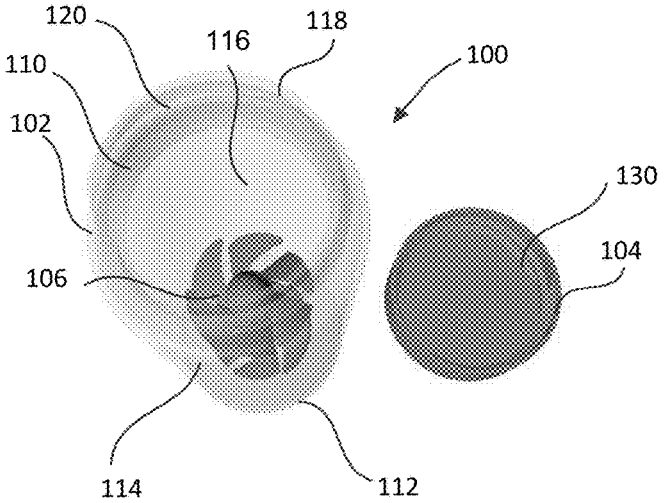
FIG. 1B is a top perspective view of the liquid container with the agitator in FIG. 1A.
Figure 1C:
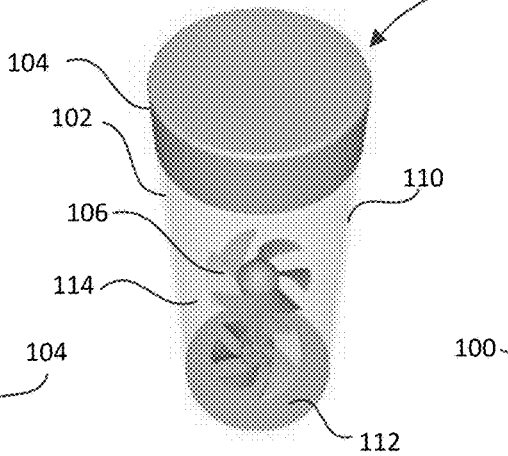
FIG. 1C is a top perspective view of the liquid container with the agitator in FIG. 1A after the lid is attached.
Figure 1D:
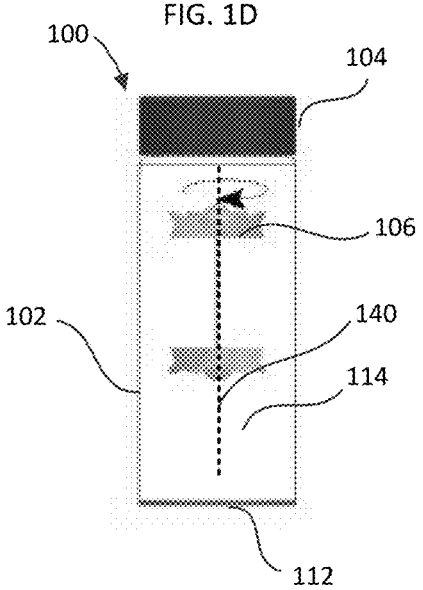
FIGS. 1D-1E are side views of the liquid container with the agitator when a lid seals the liquid container.
Figure 1E:
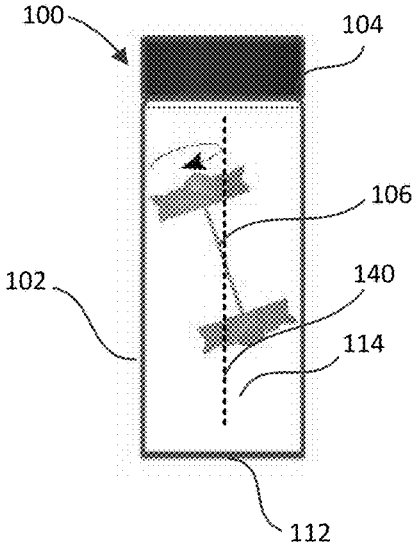

FIG. 1A is a side view of a liquid container assembly 100 that includes a liquid container 102, a lid 104, and an agitator 106. FIG. 1B is a top perspective view of the liquid container assembly 100. The liquid container 102 in this example is cylindrical in shape having an outer surface 110, a closed bottom 112, and an interior compartment 114. The interior compartment 114 is accessible via an open end 116. In this example, the liquid container 102 may be a water bottle that holds water or other liquids. The open end 116 is defined by a collar 118 that includes exterior threads 120. The lid 104 includes interior threads 130 that mate with the exterior threads 120 of the collar 118 to seal the container 102. FIG. 1C is a top perspective view of the liquid container 102 after the lid 104 is attached to seal the container 102.

The liquid container 102 in this example is cylindrical and has a central vertical axis 140. The closed bottom 112 is generally flat, allowing the liquid container 102 to be rested on any flat surface. However, although the liquid container 102 is cylindrical in this example, it may be any shape that allows convenient retention of a volume of liquid. Further, there may be any number of mechanisms to attach the lid 104 to the container 102 to create a water-tight seal. For example, the lid 104 may be a plug shape or the lid may be articulated via an attachment to the body of the liquid container 102.

Liquid is poured into the container 102 through the open end 116. Additives such as powders may also be added to the liquid from the open end 116. Alternatively, additives may be added to the container 102 before the liquid is poured into the container 102. The container 102 is sealed through attachment of the lid 104 on the collar 118. The container 102 may be composed of any water-proof material such as plastic, ceramic, glass, or metal.

In the operation of the example dual propeller agitator 106 in FIG. 1, the user shakes the liquid container 102 along the vertical axis 140 in FIG. 1. The agitator 106 moves vertically inside the container 102 roughly along the vertical axis 140 when the container 102 is held substantially upright and spins from the impact of the liquid on the propellers thereby agitating the liquid in the container 102 as shown in FIGS. 1D and 1E. The dual propeller agitator 106 allows the mixing of the liquid with the powder or other types of additives through agitation of the liquid and the additives. The agitator 106 may be fabricated with suitable materials such as plastics, metals, composites, woods, rubber, or silicone.

The container 102 may be transparent or opaque. A transparent container 102 may be desirable for a user to observe the dynamic spinning movement of the agitator 106 when the container 102 is shaken. The user may also put the container 102 on a flat surface after shaking and the agitator 106 will remain spinning for a while.

Figure 2A:
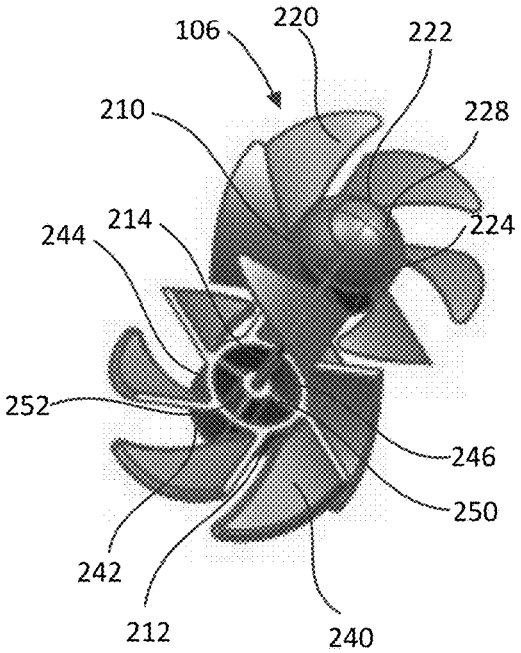
FIG. 2A is a perspective top view of the dual propeller agitator in FIG. 1.
Figure 2B:
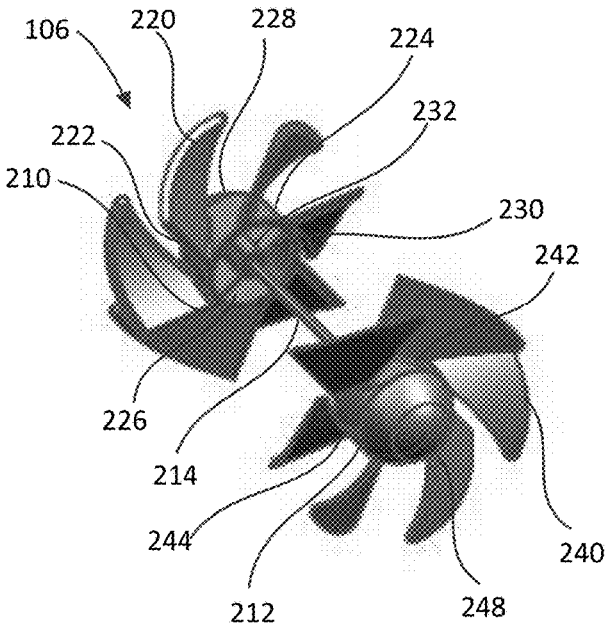
FIG. 2B is a perspective bottom view of the dual propeller agitator in FIG. 1.
Figure 2C:
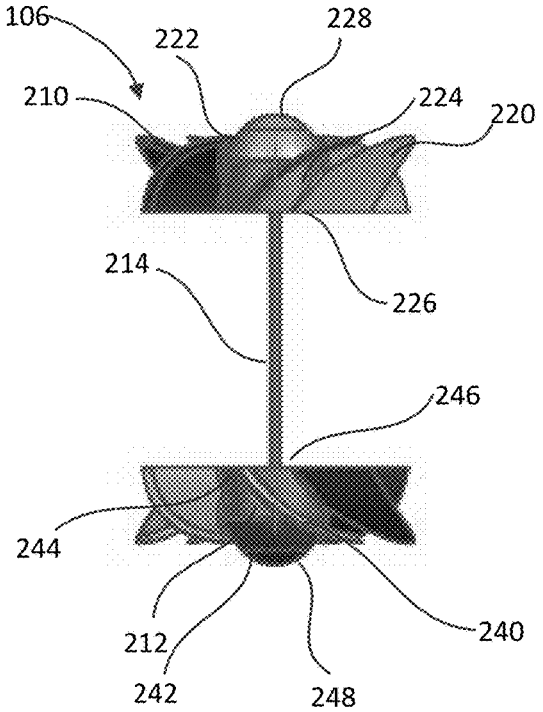
FIG. 2C is a side view of the dual propeller agitator in FIG. 1.
Figure 2D:
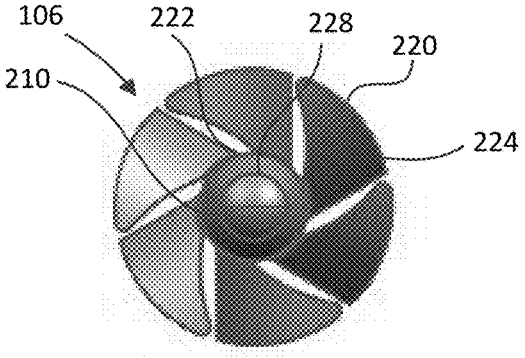
FIG. 2D is a top view of the dual propeller agitator in FIG. 1.

FIG. 2A is a perspective top view of the example agitator 106, FIG. 2B is a perspective bottom view of the example agitator 106, FIG. 2C is a side view of the example agitator 106, and FIG. 2D is a top view of the agitator 106. The agitator 106 includes a top propeller 210 and a bottom propeller 212. The two propellers 210 and 212 are attached by a rod 214. The top propeller 210 includes a number of angled blades 220 extending from a semi-spherical top hub 222. The top hub 222 includes a top cylindrical body 224 with an open end 226 and an opposite closed semi-spherical end 228. Each of the angled propeller blades 220 are attached to the exterior of the top cylindrical body 224. The surfaces of the propeller blades 220 are angled relative to the rod 214 and the top cylindrical body in order to contact the liquid propelled by the up and down motion of shaking the container 102. A series of support vanes 230 extend from the interior of the top cylindrical body 224 to support a cylindrical socket 232 extending from the interior of the closed end 228. The cylindrical socket 232 is connected to one end of the rod 214.

Similarly, the bottom propeller 212 includes a number of angled blades 240 extending from a semi-spherical bottom hub 242. The bottom hub 242 includes a bottom cylindrical body 244 with an open end 246 and an opposite closed semi-spherical end 248. Each of the angled propeller blades 240 are attached to the exterior of the bottom cylindrical body 244. A series of support vanes 250 extend from the interior of the bottom cylindrical body 244 to support a cylindrical socket 252 extending from the interior of the closed end 248. The cylindrical socket 252 is connected to the opposite end of the rod 214 from the socket 232.

When the agitator 106 is inserted in the liquid in the container 102 and shaken, the motion of the liquid impacts the angled blades 220 and 240 causing both propellers 210 and 212 to spin relative to the liquid around an axis parallel to the rod 214. In this manner, the liquid and any additives are agitated and mixed. The semi-spherical end 248 of the bottom hub 242 allows the agitator 106 to continue spinning longer if it contacts the closed bottom end 112 of the container 102. In this example, the propellers 210 and 212 have six blades 220 and 240 respectively. The blades in this example are roughly triangular in shape. Of course different numbers of blades may be used. In addition, the propellers 210 and 212 may have the same or different numbers of blades. The shapes of the blades 220 and 240 may also be of different shapes to provide maximum contact with the liquid.

There are a number of techniques to assure the agitator 106 spins generally along the vertical axis 140 of the container 102 and as long as possible. The average density of the agitator 106 may be adjusted. The average density equals its total mass (weight) divided by its total volume. If the density is lower than the density of the liquid such as water, the agitator 106 will float on the liquid. If the density is higher than the liquid, the agitator 106 will stay at the bottom of the container 102 in relation to the liquid. Different average densities from using different materials used to construct the agitator 106 may cause different spinning behavior.

A second technique is to use the side walls of the container 102 to prevent the agitator 106 from turning upside down when the agitator 106 moves toward the top and bottom of the container 102. For example, the rod 214 of the agitator 106 may be made sufficiently long relative to the diameter of the container 102 to prevent the agitator 106 from turning over.

A third technique is to allow the agitator to maintain its own stability by adjusting the center of gravity and center of buoyancy of the agitator 106. During the shaking and especially after the user stops shaking and holds the container 102 straight or put the container 102 on a flat surface, the agitator 106 will be able to stay up straight and spin perfectly when it sinks to the bottom of the container 102. In case the agitator 106 is turned upside down by the shaking motion, it will be able to turn itself back to the correct orientation. The critical design factors are the positions of the center of gravity and the center of buoyancy. One or both of these centers may be adjusted during design of the agitator 106. The center of gravity (COG) is the point in a body around which the resultant torque due to gravity forces vanishes. Buoyancy also known as upthrust is an upward force exerted by a fluid that opposes the weight of an immersed object. Buoyancy is the weight of displaced fluid and the center of buoyancy of an object is the centroid of the displaced volume of fluid. In this example, the agitator 106 is designed for rotational stability. Rotational stability depends on the relative lines of action of forces on an object. The upward buoyancy force on an object acts through the center of buoyancy, being the centroid of the displaced volume of fluid. The weight force on the object acts through its center of gravity. The object will be stable if the center of gravity is beneath the center of buoyancy because any angular displacement will then produce a "righting moment." There may be different designs to lower the position of the agitator 106 in the liquid. For example, the density of the material may be selected to be denser than the liquid in order to submerge the agitator 106. The density of the material may be selected to be less dense than the liquid so the agitator 106 floats or partially floats in the liquid. One or more of above factors could be used in the design of the agitator 106. For example, the ability to stay stable during spin could be the result of the side-wall effect from the container 102 or self-stability by center of gravity and/or center of buoyancy adjustment in the agitator 106.

In this example, the overall density of the agitator 106 is designed to be suspended or submerged in the body of the liquid such that the agitator 106 does not float at the surface of the liquid but also does not sink to the closed bottom 112 of the container 102. In this example, the relative weight of the top and bottom propellers 210 and 212 of the agitator 106 may be the same and the rod 214 is of sufficient length relative to the diameter of the container 102 that prevents the agitator 106 from tumbling over in the container 102.

As explained above, there are other ways to insure the correct orientation of the agitator 106 so the agitator 106 does not tumble over in the container 102. For example, the bottom propeller 212 of the agitator 106 may be made denser than the top propeller 210. Thus, the bottom propeller 212 will be generally oriented under the top propeller 210 regardless of how the agitator 106 is moved in the liquid. This may be accomplished by fabrication of the bottom propeller 212 with a denser material in the bottom hub 242 than the top hub 222 of the top propeller 210. Alternatively, the propeller blades 240 of the bottom propeller 212 may be a denser material than the propeller blades 220 of the top propeller 210. Alternatively, the blades 240 of the bottom propeller 212 may have a larger surface area than that of the blades 220 of the top propeller 210. Alternatively, the length of the blades 220 and 240 may be of sufficient length to be inserted in the container 102 but prevent the agitator 106 from tumbling over because of the sidewalls of the container 102. The bottom hub 242 may be fabricated as a solid piece or the spaces between the support vanes 250 may be filled in order to make the bottom hub 242 heavier than the top hub 222. The top propeller 210 may also have hollow areas cut into the propeller blades 220 to make it lighter than the bottom propeller 212.

Figure 3A:
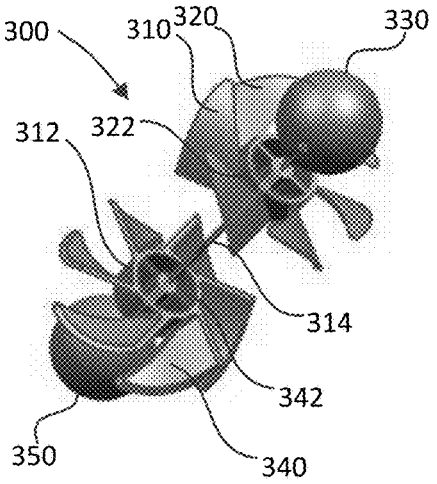
FIGS. 3A-3C are views of an alternate dual propeller agitator having spheres at the top and bottom ends of the agitator.
Figure 3B:
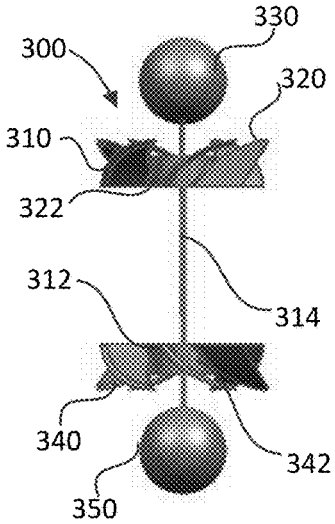
Figure 3C:
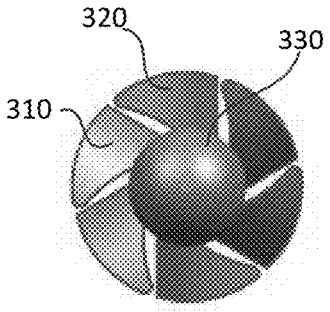

Variations of the dual propeller agitator similar to the agitator 106 may be used with the container 102. For example, FIG. 3A shows a perspective view of another example dual propeller agitator 300 having a top propeller 310 and a bottom propeller 312. FIG. 3B shows a side view of the agitator 300 and FIG. 3C shows a top view of the agitator 300. The propellers 310 and 312 are connected via a rod 314. The top propeller 310 has a series of propeller blades 320 that are connected to a top cylindrical hub 322. The bottom propeller 312 has a series of propeller blades 340 that are connected to a bottom cylindrical hub 342. The ends of the rod 314 extend through the propellers 310 and 312 and are connected to respective top and bottom spheres 330 and 350. Similar to the dual propeller agitator 106 described above, the agitator 300 may be designed to allow vertical orientation when immersed in liquid. For example, the interior of the bottom sphere 350 is a solid while the top sphere 330 is hollow, thus facilitating orientation of the agitator 300 in the liquid. The bottom sphere 350 allows the agitator 300 to remain spinning if the sphere 350 contacts the bottom of the container.

Figure 4A:
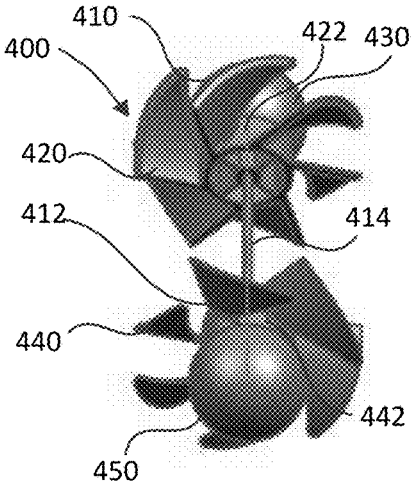
FIGS. 4A-4C are views of another alternative dual propeller agitator having spheres at the top and bottom ends of the agitator.
Figure 4B:
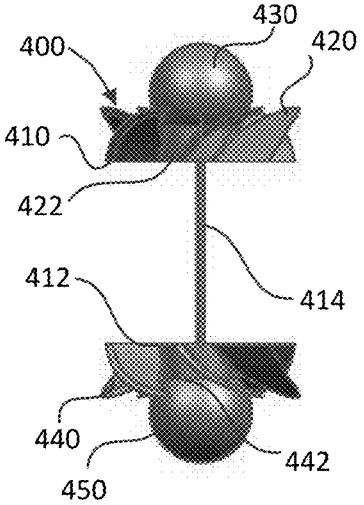
Figure 4C:
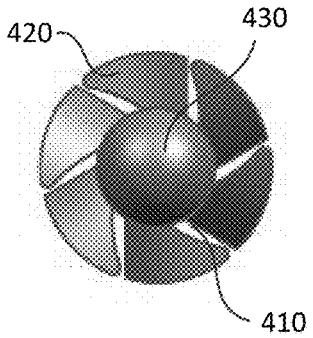

FIG. 4A shows a perspective view of another example dual propeller agitator 400 having a top propeller 410 and a bottom propeller 412. FIG. 4B shows a side view of the agitator 400 and FIG. 4C shows a top view of the agitator 400. The propellers 410 and 412 are connected via a rod 414. The top propeller 410 has a series of propeller blades 420 that are connected to a top cylindrical hub 422. The bottom propeller 412 has a series of propeller blades 440 that are connected to a bottom cylindrical hub 442. Similar to the hubs in FIG. 2A-2B, the hubs 422 and 442 have an interior surface. Support vanes are mounted between the interior surface of the hubs 422 and 442 that connect the exterior walls to a socket. The ends of the rod 414 are inserted in the sockets of the top and bottom hubs 422 and 442 respectively. The closed ends of the top and bottom hubs 422 and 442 are connected to respective top and bottom spheres 430 and 450. Similar to the agitator 106 described above, the agitator 400 may be designed to allow vertical orientation when immersed in liquid. For example, the interior of the bottom sphere 450 is a solid while the top sphere 430 is hollow, thus facilitating orientation of the agitator 400 in the liquid. The bottom sphere 450 allows the agitator 400 to remain spinning if the sphere 450 contacts the bottom of the container.

Figure 5A:
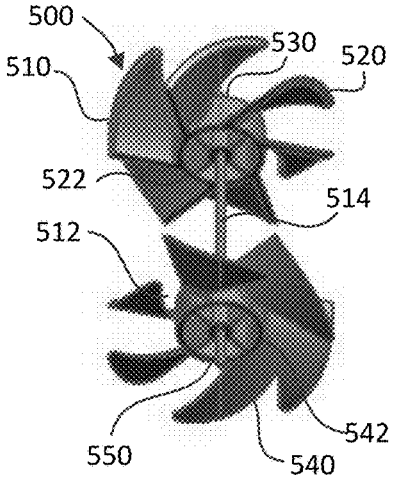
FIGS. 5A-5C are views of another alternative dual propeller agitator having needles at the top and bottom ends of the agitator.
Figure 5B:
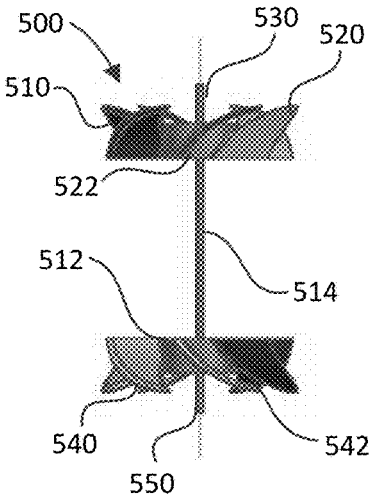
Figure 5C:
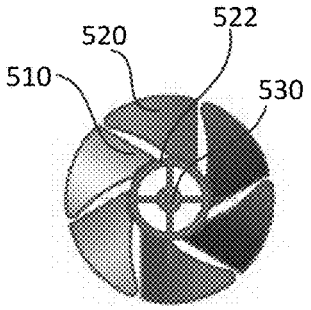

FIG. 5A shows a perspective view of another example dual propeller agitator 500 having a top propeller 510 and a bottom propeller 512. FIG. 5B shows a side view of the agitator 500 and FIG. 5C shows a top view of the agitator 500. The propellers 510 and 512 are connected via a rod 514. The top propeller 510 has a series of propeller blades 520 that are connected to a cylindrical hub 522. The bottom propeller 512 has a series of propeller blades 540 that are connected to a cylindrical hub 542. Similar to the hubs in FIG. 2A-2B, the hubs 522 and 542 have an interior surface having support vanes that connect the exterior walls to a socket. The ends of the rod 514 are inserted in the sockets of the top and bottom hubs 522 and 542 respectively. The ends of the rod 514 extend from the hubs 522 and 542 to respective top and bottom needle shaped ends 530 and 550. Similar to the agitator 106 described above, the agitator 500 may be designed to allow vertical orientation when immersed in liquid. The bottom end 550 allows the agitator 500 to remain spinning if the tip of the needle end 550 contacts the bottom of the container.

Figure 6A:
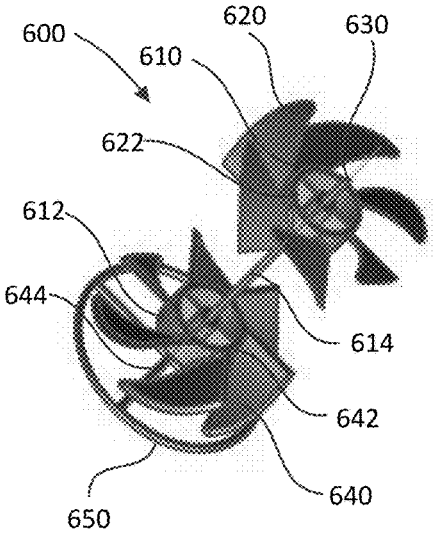
FIGS. 6A-6C are views of another alternative dual propeller agitator having a bottom ring.
Figure 6B:
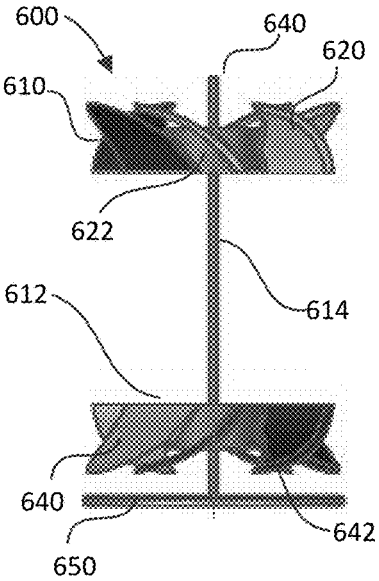
Figure 6C:
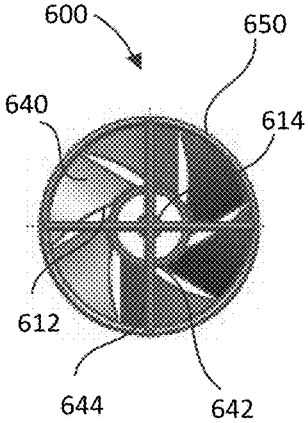

FIG. 6A shows a perspective view of another example dual propeller agitator 600 having a top propeller 610 and a bottom propeller 612. FIG. 6B shows a side view of the agitator 600 and FIG. 6C shows a bottom view of the agitator 600. The propellers 610 and 612 are connected via a rod 614. The top propeller 610 has a series of propeller blades 620 that are connected to a top cylindrical hub 622. The bottom propeller 612 has a series of propeller blades 640 that are connected to a bottom cylindrical hub 642. Similar to the hubs in FIG. 2A-2B, the hubs 622 and 642 have an interior surface having support vanes that connect the exterior walls to a socket. One end of the rod 614 is inserted through the socket of the top hub 622 and a tip 630 extends from the top propeller 610. The other end of the rod 614 extends through the socket of the bottom hub 642 and is attached to lateral arms 644. The lateral arms 644 extend perpendicular to the rod 614 and are attached to a ring 650. The ring 650 has a diameter slightly larger than the diameter of the propeller blades 640. Similar to the agitator 106 described above, the agitator 600 may be designed to allow vertical orientation when immersed in liquid. The ring 650 is of a sufficient diameter to prevent the agitator 600 from being tipped over in the liquid container. The ring 650 is also used to adjust the center of gravity of the agitator 600 to allow vertical orientation.

Figure 7A:
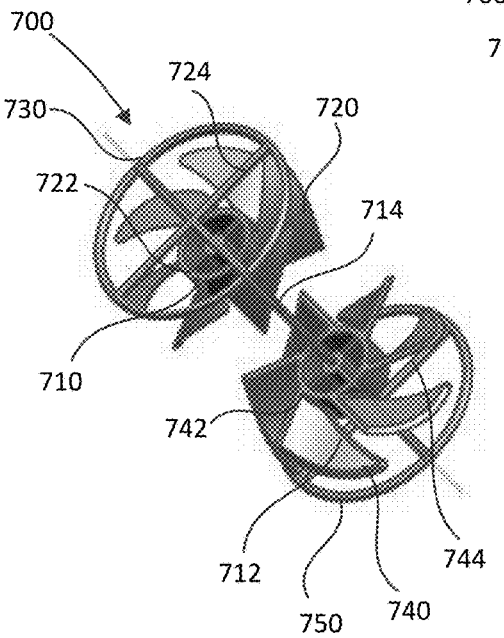
FIGS. 7A-7C are views of another alternative dual propeller agitator having top and bottom rings.
Figure 7B:
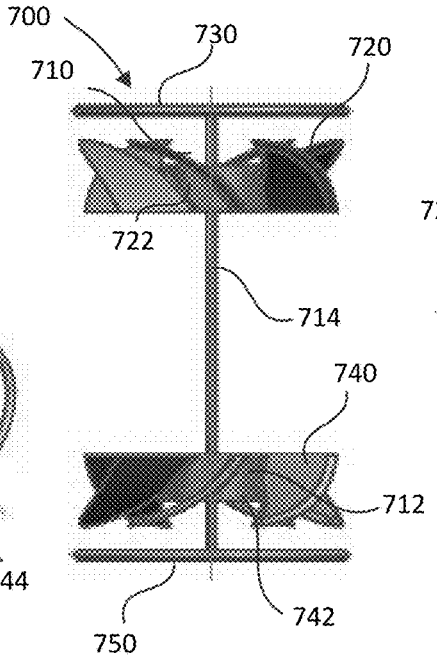
Figure 7C:
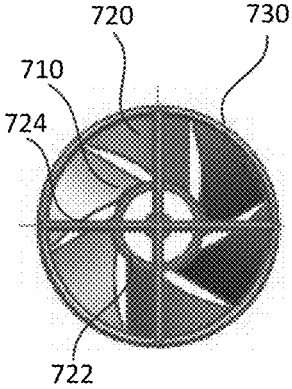

FIG. 7A shows a perspective view of another example two propeller agitator 700 having a top propeller 710 and a bottom propeller 712. FIG. 7B shows a side view of the agitator 700 and FIG. 7C shows a top view of the agitator 700. The propellers 710 and 712 are connected via a rod 714. The top propeller 710 has a series of propeller blades 720 that are connected to a top cylindrical hub 722. The bottom propeller 712 has a series of propeller blades 740 that are connected to a bottom cylindrical hub 742. Similar to the hubs in FIG. 2A-2B, the hubs 722 and 742 have an interior surface having support vanes that connect the exterior walls to a socket. The ends of the rod 714 are inserted through the sockets of the top and bottom hubs 722 and 742 respectively. The top end of the rod 714 is connected to lateral support arms 724 that support a ring 730 that has a diameter roughly the same as the propeller blades 720. The bottom end of the rod 714 is connected to lateral support arms 744 that support a ring 750 having a diameter roughly the same as the propeller blades 740. Similar to the agitator 106 described above, the agitator 700 may be designed to allow vertical orientation when immersed in liquid. In this example, the bottom ring 750 is solid throughout while the top ring 730 is hollow to adjust the buoyancy and gravity of the agitator 700 to remain in a vertical orientation when immersed in liquid.

Figure 8A:
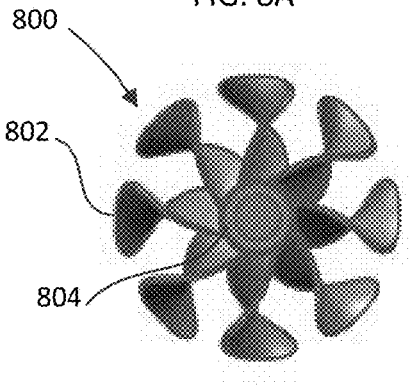
FIG. 8A-8G are views of the agitators in FIGS. 2A-7C with eight bladed propellers.
Figure 8B:
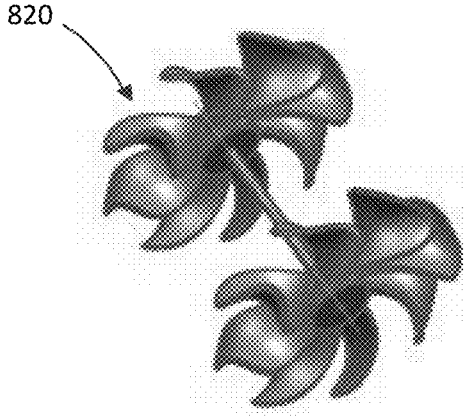
Figure 8C:
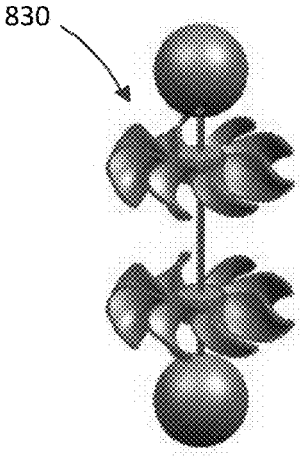
Figure 8D:
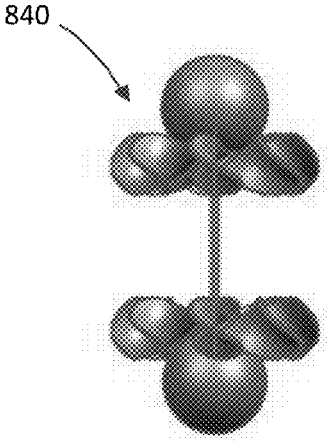
Figure 8E:
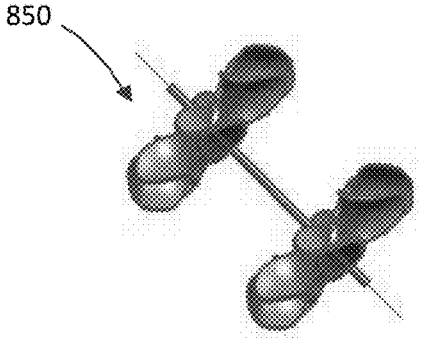
Figure 8F:
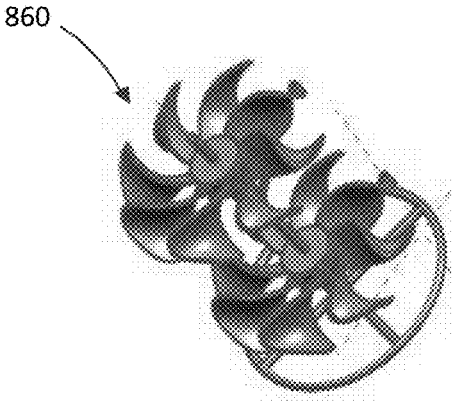
Figure 8G:
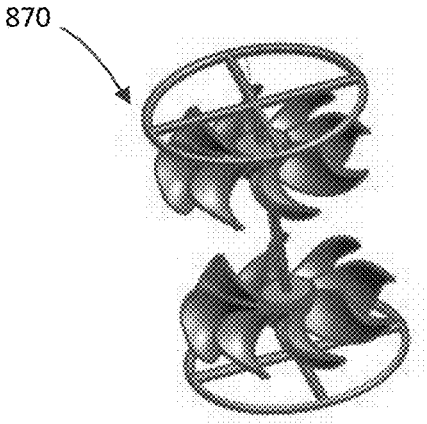

The above described agitators all include propellers having six blades. As explained above, there may be propellers with different numbers of blades and blades of different shapes. FIG. 8A is an example propeller 800 that has eight blades 802 attached to a cylindrical hub 804. As may be seen in FIG. 8A, the blades 802 are shaped differently than the blades of the propellers of the agitators shown in FIGS. 2-7. It is to be understood that there may be any number of differently shaped blades used in any of these examples to cause the agitation of the liquid. The propeller 800 may be used instead of the propellers of the agitators shown in FIGS. 2-7. FIG. 8B shows an example dual propeller agitator 820 similar to the agitator 106 in FIGS. 2A-2D with eight bladed top and bottom propellers. FIG. 8C shows an example dual propeller agitator 830 similar to the agitator 300 in FIGS. 3A-3E with eight bladed top and bottom propellers. FIG. 8D shows an example dual propeller agitator 840 similar to the agitator 400 in FIGS. 4A-4E with eight bladed top and bottom propellers. FIG. 8E shows an example dual propeller agitator 850 similar to the agitator 500 in FIGS. 5A-5C with eight bladed top and bottom propellers. FIG. 8F shows an example dual propeller agitator 860 similar to the agitator 600 in FIGS. 6A-6C with eight bladed top and bottom propellers. FIG. 8G shows an example dual propeller agitator 870 similar to the agitator 700 in FIGS. 7A-7C with eight bladed top and bottom propellers. The shapes of the blades may also be constructed to be contained in a turbine structure for each of the example agitators.

Figure 9A:
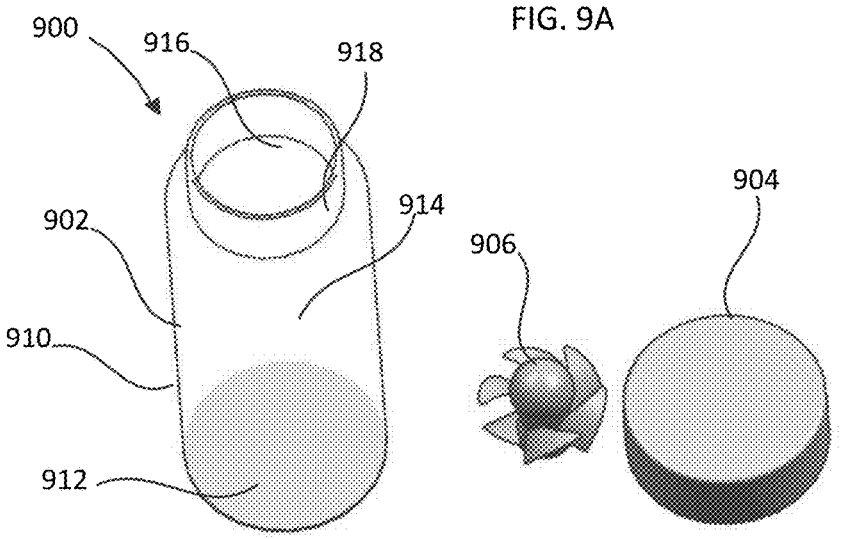
FIG. 9A is an exploded perspective view of a liquid bottle with another example of an agitator with one set of blades.
Figure 9B:
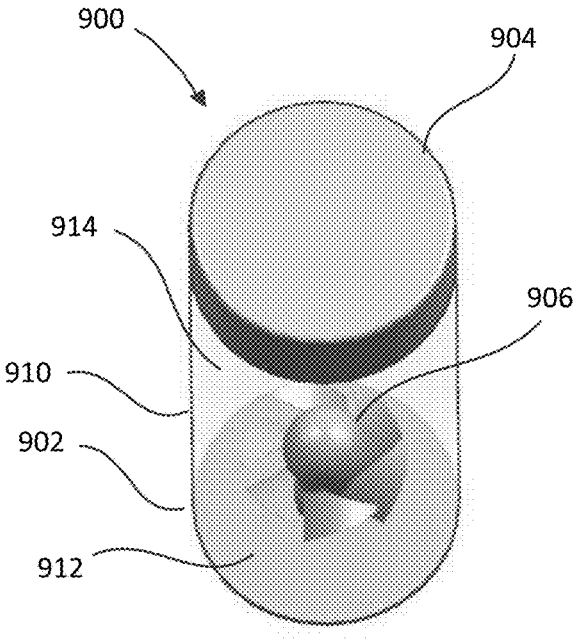
FIG. 9B is a perspective view of the liquid container with the agitator in FIG. 9A.
Figure 9C:
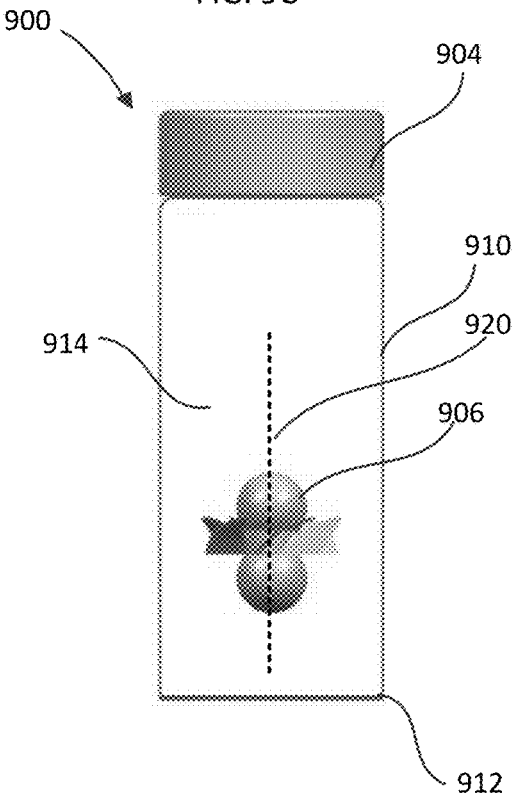
FIG. 9C is a side view of the liquid container with the agitator in FIG. 9A.

FIG. 9A is an exploded perspective view of a liquid container assembly 900 that includes a liquid container 902, a lid 904, and an example single propeller agitator 906. FIG. 9B is a perspective view of the agitator 906 inserted in the sealed liquid container 902, and FIG. 9C is a side view of the agitator 906 inserted in the sealed liquid container 902. The liquid container 902 in this example is cylindrical in shape having an outer surface 910, a closed bottom 912, and an interior compartment 914. The interior compartment 914 is accessible via an open end 916. The open end 916 is defined by a collar 918 that includes exterior threads. The lid 904 includes interior threads that mate with the exterior threads when the lid 904 is attached to the liquid container 902.

Liquid is poured into the container 902 through the open end 916. Additives such as powders may also be added to the liquid. The container 902 is sealed through attachment of the lid 904. In the operation of the example agitator 906 in FIG. 9, the user shakes the liquid container 902 along a vertical axis 920 in FIG. 9C. The agitator 906 moves vertically inside the container 902 and spins, thereby agitating the liquid in the container 902. The agitator 906 allows the mixing of the liquid with the powder or other types of additives with the liquid.

Figure 9D:
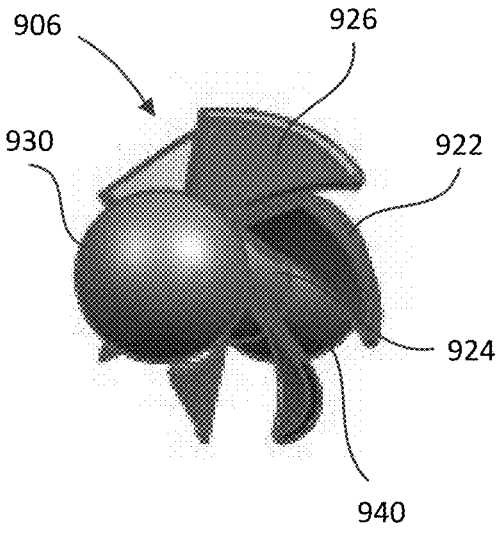
FIGS. 9D-9G are different views of the agitator shown in FIG. 9A.
Figure 9E:
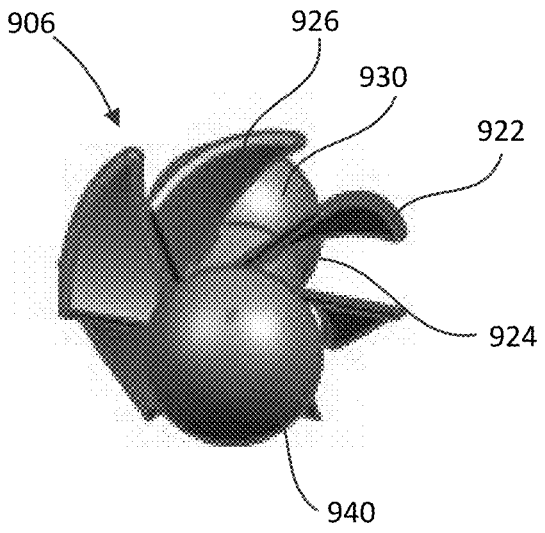
Figure 9F:
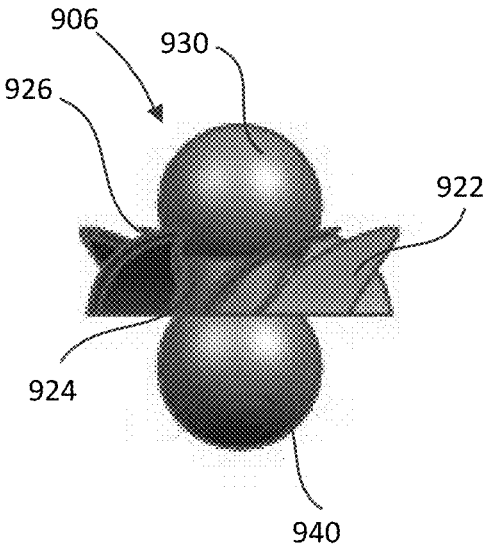
Figure 9G:
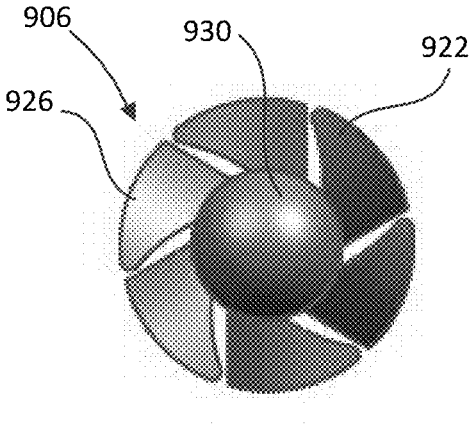

FIG. 9D shows a top perspective view of the agitator 906. FIG. 9E shows a bottom perspective view of the agitator 906, FIG. 9F shows a side view of the agitator 906, and FIG. 9G shows a top view of the agitator 906. The agitator 906 includes a single propeller 922 that has a cylindrical hub 924 with a series of propeller blades 926 extending from the cylindrical hub 924. Top and bottom spheres 930 and 940 are installed on the top and bottom of the cylindrical hub 924. Similar to the agitator 106 described above, the agitator 906 may be designed to allow vertical orientation when immersed in liquid. For example, the interior of the bottom sphere 940 is a solid while the top sphere 930 is hollow, thus facilitating orientation of the agitator 906 in the liquid. The bottom sphere 940 allows the agitator 906 to remain spinning if the sphere 940 contacts the bottom of the container 902.

Figure 10A:
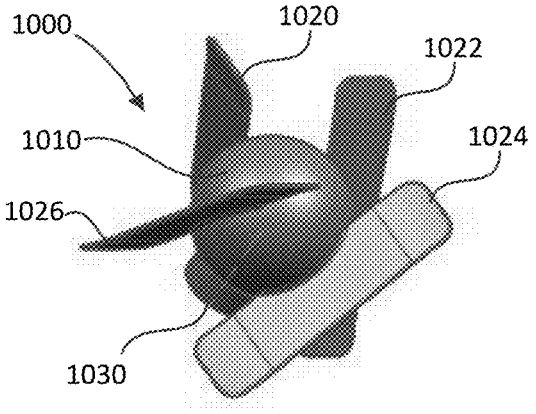
FIG. 10A is a top perspective view of another example agitator.
Figure 10B:
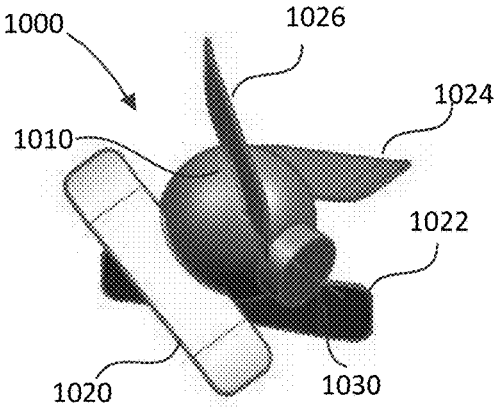
FIG. 10B is a bottom perspective view of the agitator in FIG. 10A.
Figure 10C:
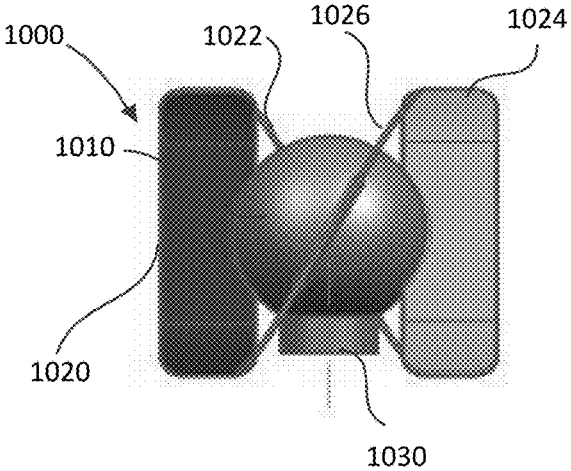
FIG. 10C is a side view of the agitator in FIG. 10A.
Figure 10D:
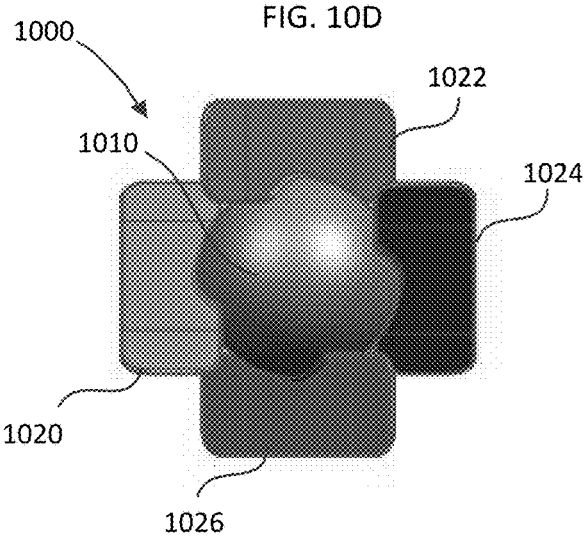
FIG. 10D is a top view of the agitator in FIG. 10A.
Figure 10E:
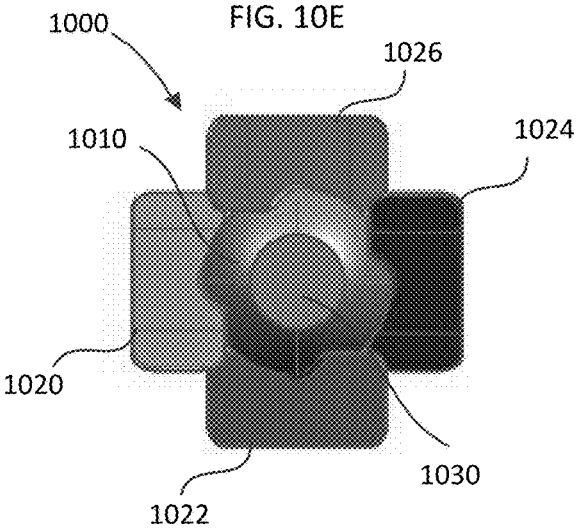
FIG. 10E is a bottom view of the agitator in FIG. 10A.

FIG. 10A is a perspective top view of another example agitator 1000, FIG. 10B is a perspective bottom view of the example agitator 1000, FIG. 10C is a side view of the example agitator 1000, FIG. 10D is a top view of the example agitator 1000, and FIG. 10E is a bottom view of the agitator 1000. The agitator 1000 includes a spherical body 1010. A series of four blades 1020, 1022, 1024, and 1026 are attached circumferentially on the spherical body 1010. The blades 1020, 1022, 1024, and 1026 are roughly rectangular in shape and mounted at an angle relative to the horizontal plane in order to provide area for contact with liquid to rotate the agitator 1000. The spherical body 1010 is mounted on a cylindrical base member 1030. The agitator 1000 may be weighted so the cylindrical base member 1030 is always oriented at the bottom of a container. The spherical body 1010 may have a designated mass that allows it to be suspended when immersed in the liquid in the container. The height and the diameter of the body 1010 make it possible to use the side wall of the container to prevent the agitator 1000 from being turned upside down. As will be explained below, the body 1010 may have other shapes for aesthetic purposes. The body 1010 could be used to adjust the buoyancy and gravity, such as by having an upper part with lower density and a bottom part that has higher density.

Figure 10F:
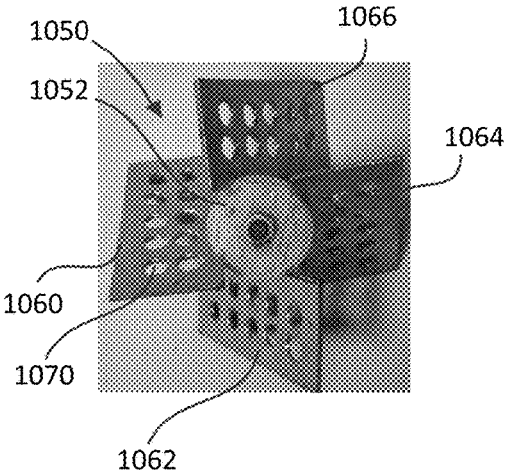
FIG. 10F is a perspective view of another example agitator.

FIG. 10F is a perspective bottom view of another example agitator 1050 with modified blades. The agitator 1050 includes a spherical body 1052. A series of four blades 1060, 1062, 1064, and 1066 are attached circumferentially on the spherical body 1052. The blades 1060, 1062, 1064, and 1066 are roughly rectangular in shape and mounted at an angle relative to the horizontal plane. Each of the blades 1060, 1062, 1064, and 1066 has a number of holes 1070. The holes 1070 divert the liquid through the holes 1070 to assist in the agitation of the liquid. The holes 1070 also allow adjustment of the force to spin the agitator 1050 and therefore the spinning behavior of the agitator 1050.

Figure 11A:
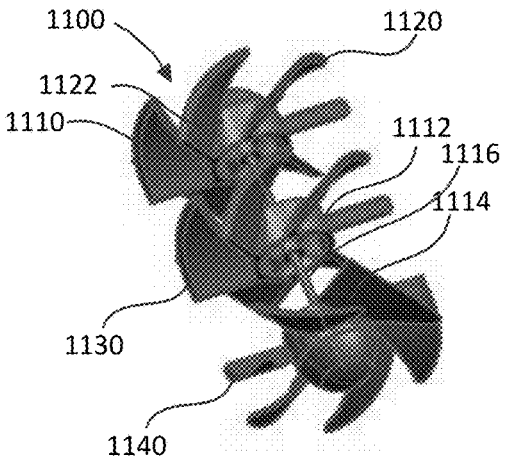
FIGS. 11A-11G are views of different example agitators having three propellers.
Figure 11B:
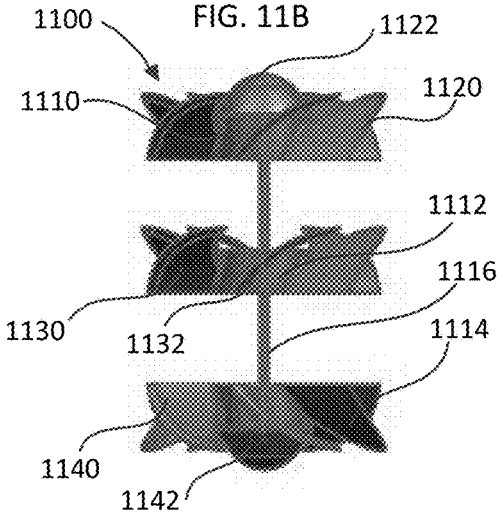

Different numbers of propellers may be used rather that than the two propeller arrangement in the agitators shown in FIGS. 2-7. FIG. 11A is a perspective view of a three propeller agitator 1100. FIG. 11B is a side view of the three propeller agitator 1100. The agitator 1100 includes a top propeller 1110, a middle propeller 1112, and a bottom propeller 1114. The propellers 1110, 1112, and 1114 are attached to a rod 1116. The top propeller 1110 includes a number of angled blades 1120 extending from a semi-spherical top hub 1122. The top hub 1122 includes a socket for receiving one end of the rod 1116. The middle propeller 1112 includes a number of angled blades 1130 extending from a middle cylindrical hub 1132. The rod 1116 extends through the middle cylindrical hub 1132. The bottom propeller 1114 includes a number of angled blades 1140 extending from a bottom semi-spherical hub 1142. The bottom hub 1142 receives the other end of the rod 1116.

When the agitator 1100 is inserted in the liquid in a container such as the container 102 in FIG. 1 and shaken, the motion of the liquid impacts the blades 1120, 1130, and 1140 causing the propellers 1110, 1112, and 1114 to spin relative to the liquid around an axis parallel to the rod 1116. In this manner, the liquid and any additives are agitated and mixed. The semi-spherical end of the bottom hub 1142 allows the agitator 1110 to continue spinning longer if it contacts the closed bottom end of the container. In this example, the propellers 1110, 1112, and 1114 have six blades 1120, 1130, and 1140 respectively. The blades in this example are roughly triangular in shape. Of course different numbers of blades may be used. In addition, the propellers 1110, 1112, and 1114 may have the same or different numbers of blades. The shapes of the blades 1120, 1130, and 1140 may also be of different shapes to provide maximum contact with the liquid. As with the previous examples, the agitator 1100 may be designed to be vertically orientated when immersed in liquid so the top propeller 1110 is at the top and the bottom propeller 1114 is at the bottom. In this example, the top hub 1122 is hollow while the bottom hub 1142 is solid to facilitate this orientation.

Figure 11C:
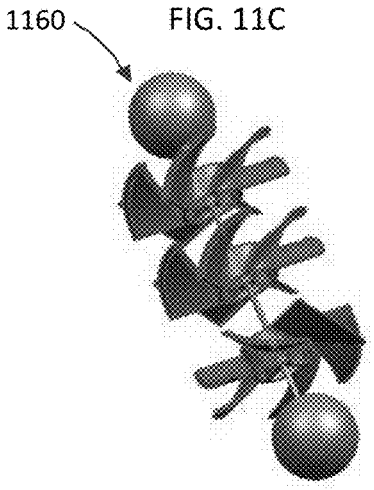
Figure 11D:
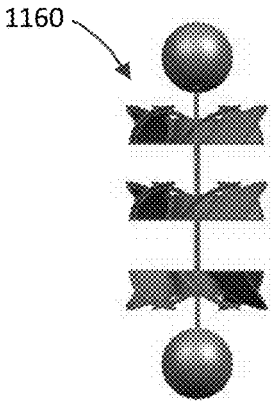
Figure 11E:
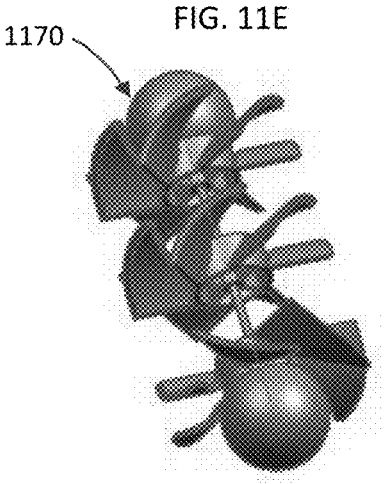
Figure 11F:
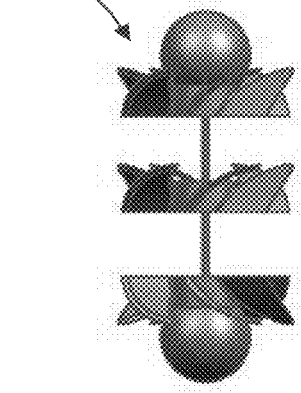
Figure 11G:
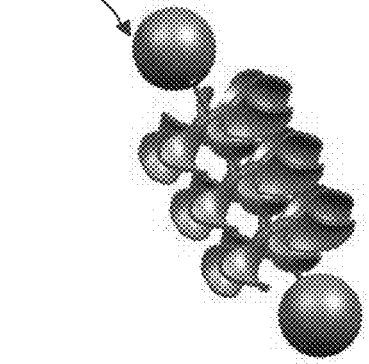

Other examples of agitators with three propellers are shown in FIGS. 11C-11G. FIG. 11C is a perspective view and FIG. 11D is a side view of an example three propeller agitator 1160 that has spheres mounted at the top and the bottom of the agitator 1160 similar to the agitator 300 shown in FIG. 3A-3C. FIG. 11E is a perspective view and FIG. 11F is a side view of an example three propeller agitator 1170 that has spheres mounted in contact with the top and the bottom propellers similar to the agitator 400 shown in FIG. 4A-4C. FIG. 11G is a perspective view of a three propeller agitator 1180 that has propellers with eight blades similar to the agitator 1160 in FIG. 11C.

Figure 12A:
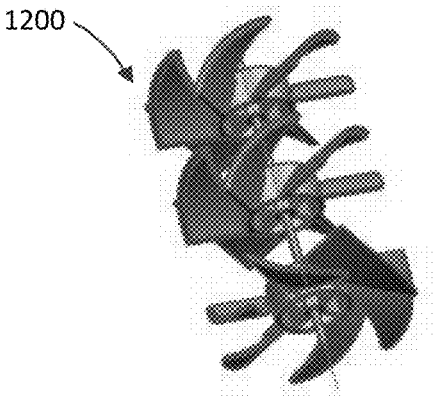
FIGS. 12A-12G are views of different example agitators having three propellers.
Figure 12B:
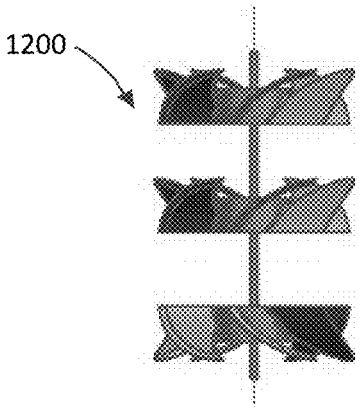
Figure 12C:
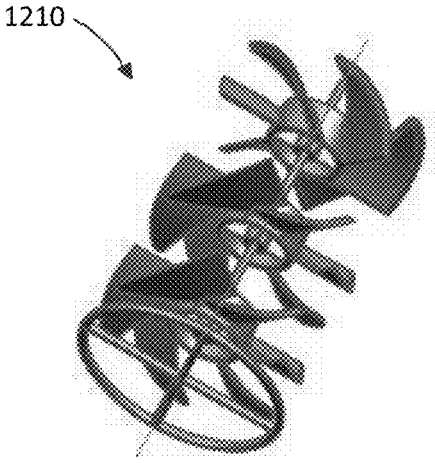
Figure 12D:
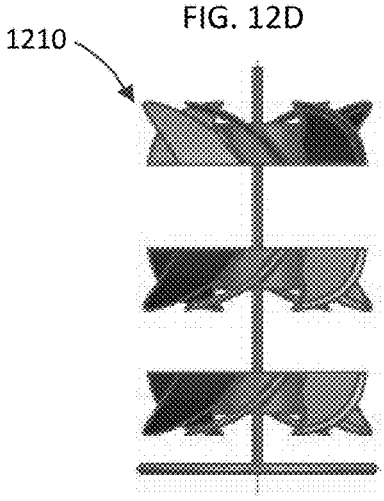
Figure 12E:
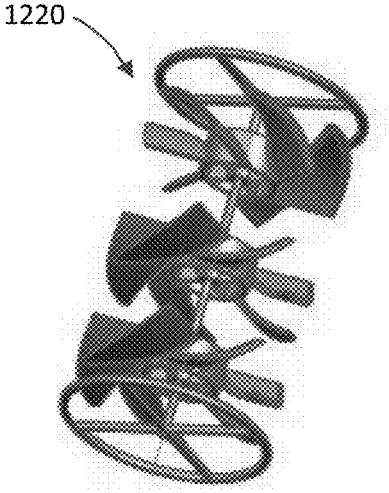
Figure 12F:
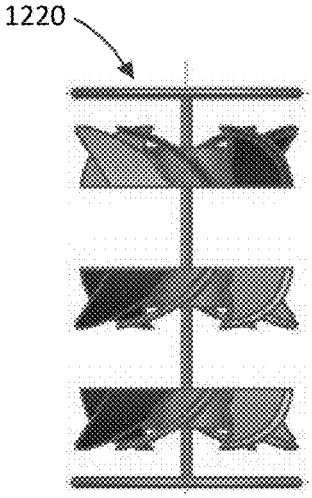
Figure 12G:
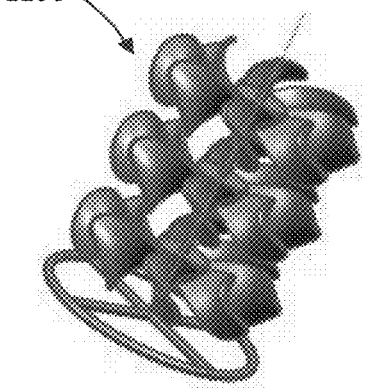

Still other examples of agitators with three propellers are shown in FIGS. 12A-12G. FIG. 12A is a perspective view and FIG. 12B is a side view of an example three propeller agitator 1200 that has the ends of the rod extending from the top and bottom propellers similar to the agitator 500 shown in FIG. 5A-5C. FIG. 12C is a perspective view and FIG. 12D is a side view of an example three propeller agitator 1210 that has a ring mounted at the bottom of the agitator 1210 similar to the agitator 600 shown in FIG. 6A-6C. FIG. 12E is a perspective view and FIG. 12F is a side view of an example three propeller agitator 1220 that includes rings mounted outside of the top and the bottom propellers similar to the agitator 700 shown in FIG. 7A-7C. FIG. 12G is a perspective view of a three propeller agitator 1230 that has propellers with eight blades similar to the agitator 1210 in FIG. 12C.

Figure 13A:
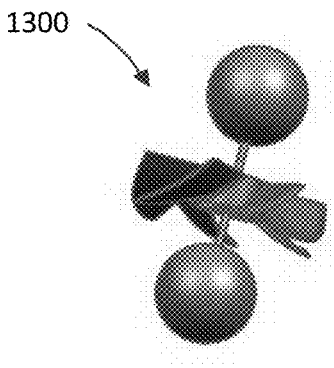
FIGS. 13A-13H are views of different example agitators having a single propeller.
Figure 13B:
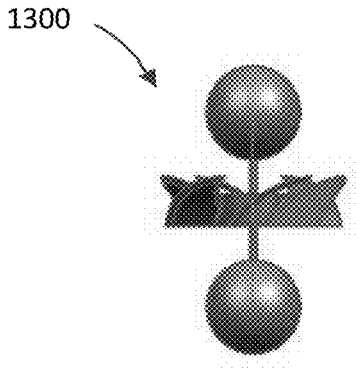
Figure 13C:
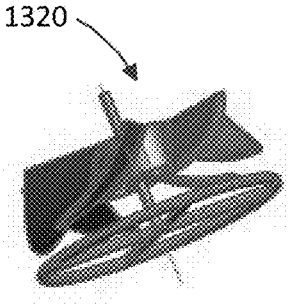
Figure 13D:
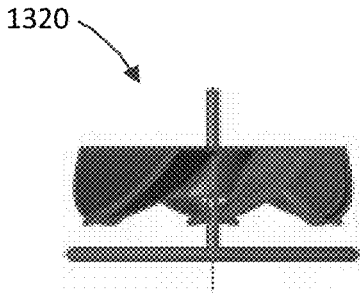
Figure 13E:
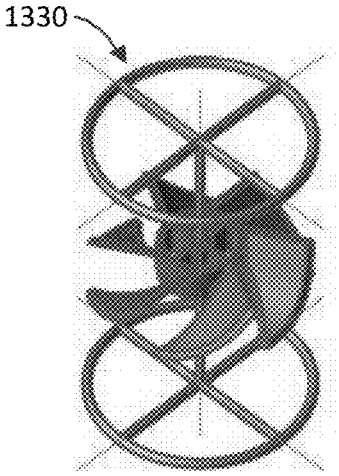
Figure 13F:
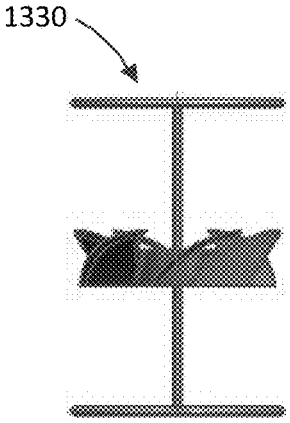
Figure 13G:
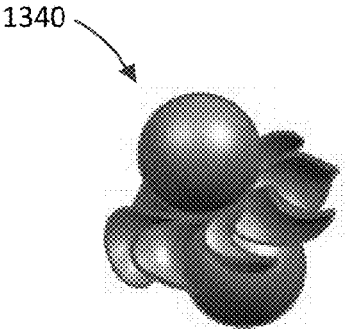
Figure 13H:
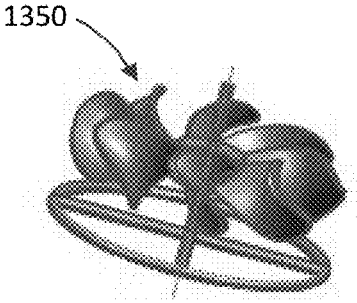

Another example of a propeller based agitator may be an agitator with a single propeller. FIG. 13A is a perspective view and FIG. 13B is a side view of one example of a single propeller agitator 1300. The single propeller agitator 1300 includes spheres on the top and the bottom ends of a rod similar to the dual propeller agitator 300 shown in FIGS. 3A-3E. FIG. 13C is a perspective view and FIG. 13D is a side view of an example single propeller agitator 1320 that has a ring mounted at the bottom of the agitator 1320 similar to the dual propeller agitator 600 shown in FIG. 6A-6C. FIG. 13E is a perspective view and FIG. 13F is a side view of an example single propeller agitator 1330 that includes rings mounted outside of the propeller similar to the dual propeller agitator 700 shown in FIG. 7A-7C. FIG. 13G is a perspective view of a single propeller agitator 1340 that has eight blades in an arrangement similar to the six bladed propeller of the agitator 1310 in FIG. 13C. FIG. 13H is a perspective view of a single propeller agitator 1350 that has eight blades in an arrangement similar to the six bladed propeller of the agitator 906 in FIGS. 13D-13F.

Figure 14A:
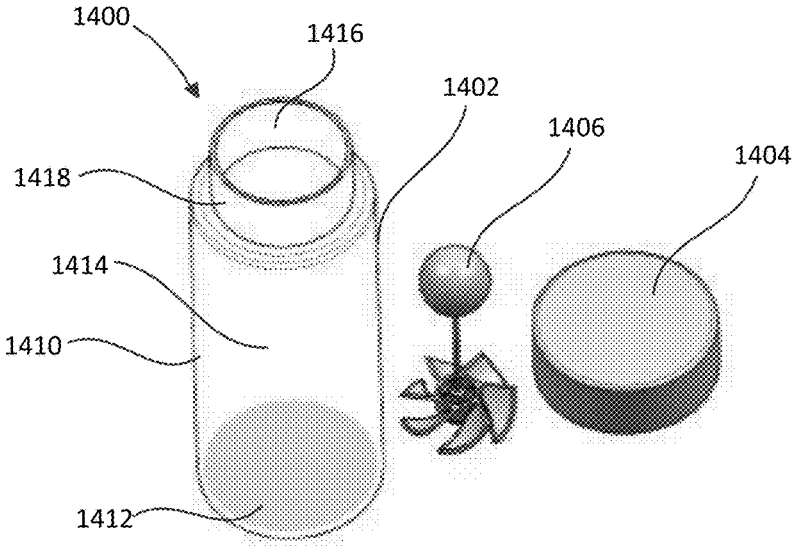
FIG. 14A is an exploded perspective view of a liquid bottle with another example of an agitator with one set of blades.
Figure 14B:
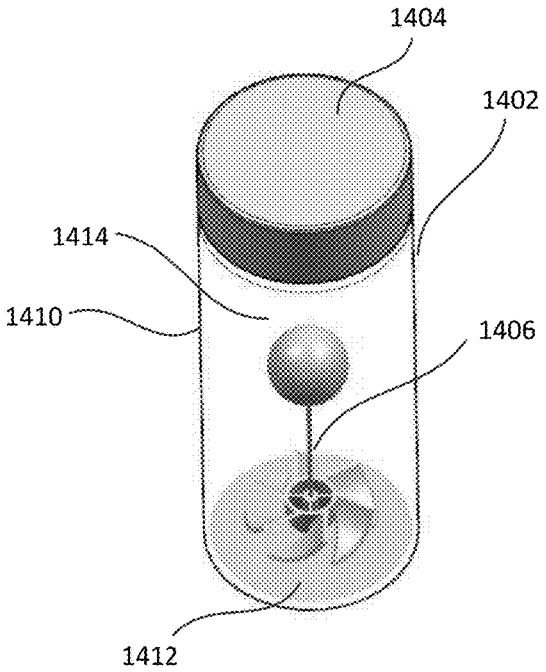
FIG. 14B is a perspective view of the liquid container with the agitator in FIG. 14A.
Figure 14C:
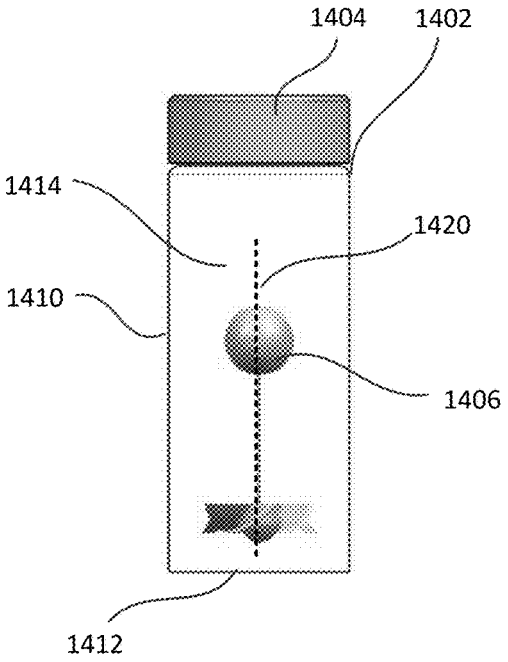
FIG. 14C is a side view of the liquid container with the agitator in FIG. 14A.

FIG. 14A is an exploded perspective view of a liquid container assembly 1400 that includes a liquid container 1402, a lid 1404, and another example single propeller agitator 1406. FIG. 14B is a perspective view of the agitator 1406 inserted in the sealed liquid container 1402 and FIG. 14C is a side view of the agitator 1406 inserted in the sealed liquid container 1402. The liquid container 1402 in this example is cylindrical in shape having an outer surface 1410, a closed bottom 1412, and an interior compartment 1414. The interior compartment 1414 is accessible via an open end 1416. The open end 1416 is defined by a collar 1418 that includes exterior threads. The lid 1404 includes interior threads that mate with the exterior threads when the lid 1404 is attached to the liquid container 1402.

Liquid is poured into the container 1402 through the open end 1416. Additives such as powders may also be added to the liquid. The container 1402 is sealed through attachment of the lid 1404. In the operation of the example agitator 1406 in FIG. 14A-14C, the user shakes the liquid container 1402 along a vertical axis 1420 in FIG. 14C. The agitator 1406 moves vertically inside the container 1402 and spins, thereby agitating the liquid in the container 1402. The agitator 1406 allows the mixing of the liquid with the powder or other types of additives with the liquid.

Figure 14D:
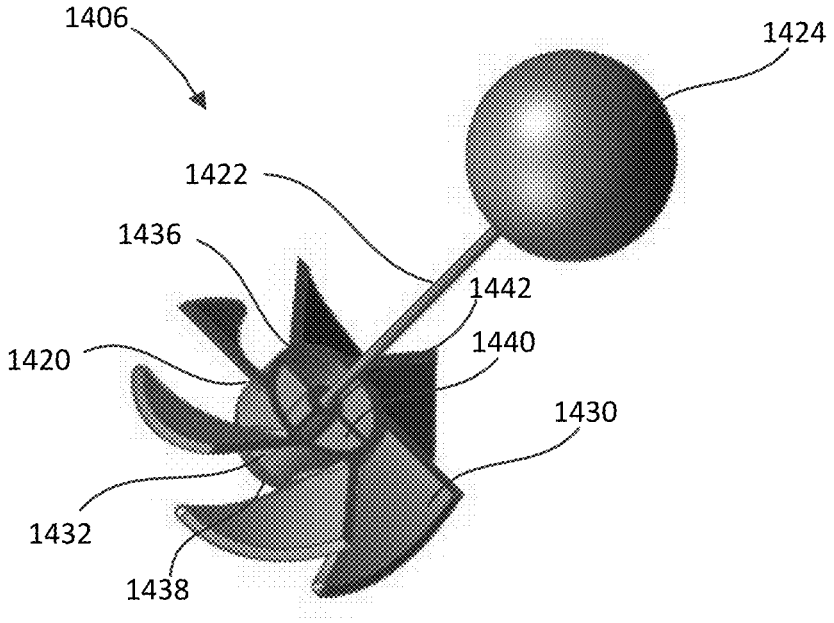
FIG. 14D is a perspective view of the agitator shown in FIG. 14A.
Figure 14E:
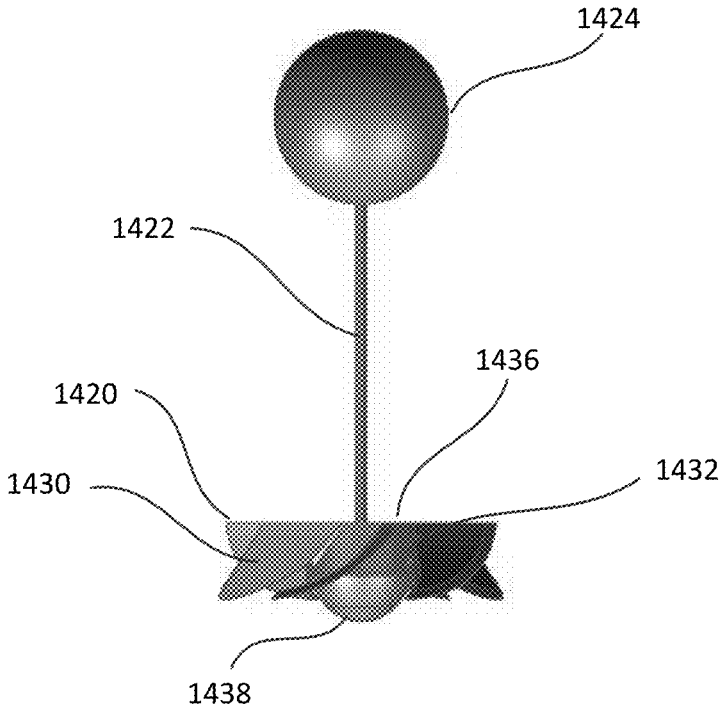
FIG. 14E is a side view of the agitator shown in FIG. 14A.

FIG. 14D shows a top perspective view of the agitator 1406 and FIG. 14E shows a side view of the agitator 1406. The agitator 1406 includes a single propeller 1420, a rod 1422, and a float element such as a top sphere 1424. The propeller 1420 is oriented opposite the top sphere 1424. The propeller 1420 includes a cylindrical body 1432 that supports angled propeller blades 1430. The cylindrical body 1432 includes an open end 1436 and an opposite closed semi-spherical end 1438. The propeller blades 1430 are angled relative to the rod 1422 in order to contact the liquid propelled by the up and down motion of shaking the container 1402. A series of support vanes 1440 extend from the interior of the top cylindrical body 1432 to support a cylindrical socket 1442 extending from the interior of the closed end 1438. The cylindrical socket 1442 is connected to one end of the rod 1422.

The agitator 1406 may be designed to allow vertical orientation of the sphere 1424 above the propeller 1420 when immersed in liquid. For example, the propeller 1420 may have greater mass than the sphere 1424, thus facilitating orientation of the agitator 1406 in the liquid. The closed spherical end 1438 allows the agitator 1406 to remain spinning if the end 1438 contacts the bottom of the container 1402. In this example, the float element may have another shape, other than the sphere 1424, that functions to allow vertical orientation of the float element above the propeller 1420 when immersed in liquid. In addition, the rod 1422 may be of sufficient length relative to the diameter of the container 1402 to prevent the agitator 1406 from turning over.

As explained above, a weight mechanism may be applied to the example propeller agitators to adjust the centroid of the agitator to balance and stabilize it and enable the propeller to "stand" in the liquid within the container. In this example, the propeller would be oriented above the weight mechanism. A buoyancy mechanism such as a float element may be applied to the example propeller agitators to adjust the centroid of the agitator to balance stabilize it and enable the propeller to be oriented relative to the liquid within a container. One example of this is the sphere 1424 shown in FIG. 14A-14E.

One or more circular wires may be added to connect the edge of the propeller blades to enhance the propeller structure and enable the propeller to be oriented in a certain position relative to the liquid. The wire or any other parts to make the agitator wider or longer use the side wall to prevent the agitator from being turned upside down. The wire is thus attached to an outer edge of each of the plurality of blades and the wire defines a perimeter of a circle. The angle that the propeller blades are mounted relative to the mounting hubs may be adjusted for different agitation effects.

The above described agitators may be altered for other stirring mechanisms. For example all of the above described propeller agitators may be connected to a long rod for hand blending or mixing of the liquid inside a container by moving the propeller up and down and/or spin. Alternatively, the propeller agitators may be connected to a long rod that is driven by an electric motor for blending or mixing of the liquid inside the container by rotating the rod and thereby the propeller or propellers to agitate the liquid.

Figure 15:
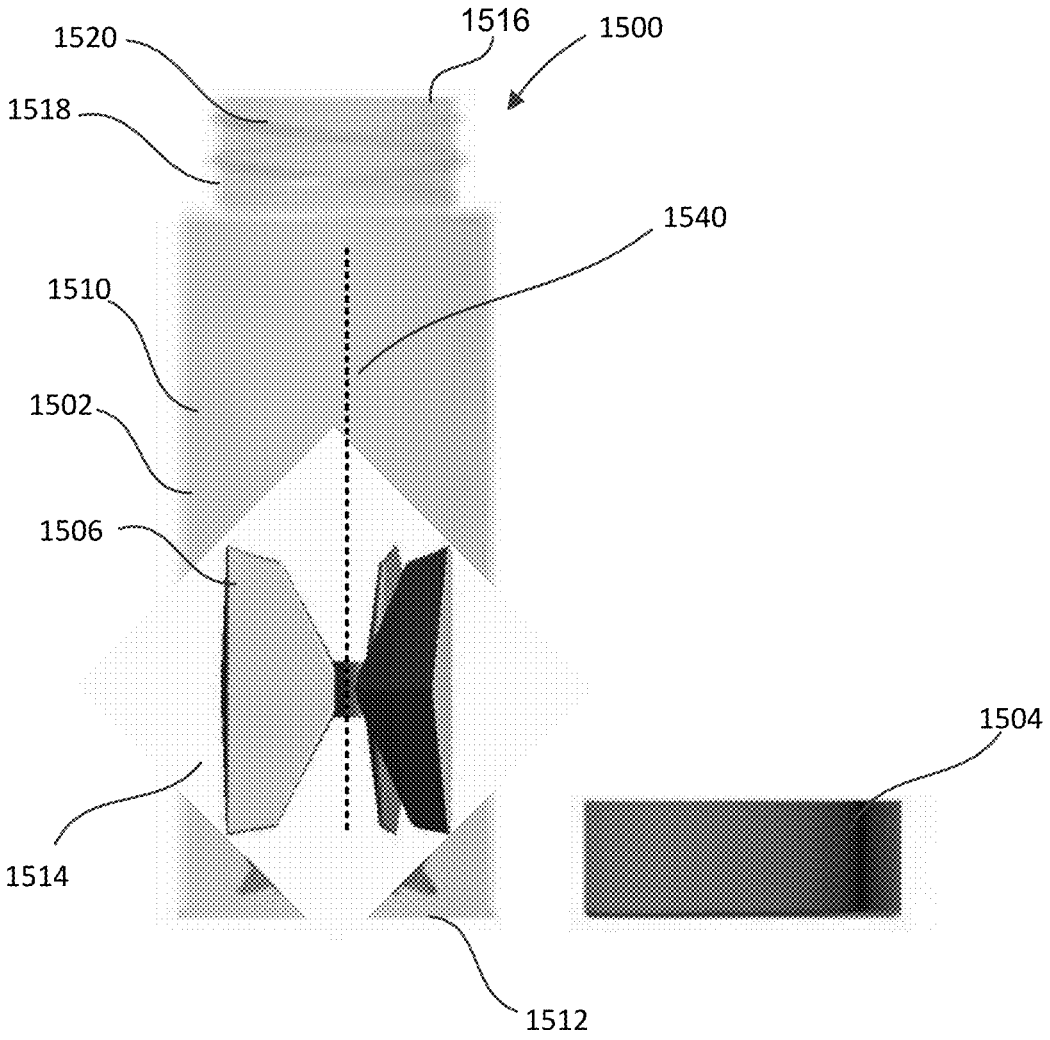
FIG. 15 is a side view of a liquid container with another example of a triple bladed agitator inserted in the container.

FIG. 15 is a side view of a liquid container assembly 1500 that includes a liquid container 1502, a lid 1504, and another example agitator 1506. The liquid container 1502 in this example is cylindrical in shape having an outer surface 1510, a closed bottom 1512, and an interior compartment 1514. The interior compartment 1514 is accessible via an open end 1516. In this example, the liquid container 1502 may be a water bottle that holds water or other liquids. The open end 1516 is defined by a collar 1518 that includes exterior threads 1520. The lid 1504 includes interior threads that mate with the exterior threads 1520 of the collar 1518 to seal the container 1502. The agitator 1506 is physically independent from the liquid container 1502 and therefore none of the component parts of the agitator 1506 are attached to the liquid container 1502. Thus, the agitator 1506 may move freely in relation to the liquid container 1502 when it is inserted in liquid contained by the liquid container 1502.

The liquid container 1502 in this example is cylindrical and has a central vertical axis 1540. The closed bottom 1512 is generally flat, allowing the liquid container 1502 to be rested on any flat surface. However, although the liquid container 1502 is cylindrical in this example, it may be any shape that allows convenient retention of a volume of liquid. Further, there may be any number of mechanisms to attach the lid 1504 to the container 1502 to create a water-tight seal.

Liquid is poured into the container 1502 through the open end 1516. Additives such as powders may also be added to the liquid from the open end 1516. Alternatively, additives may be added to the container 1502 before the liquid is poured into the container 1502. The container 1502 is sealed through attachment of the lid 1504 on the collar 5118. The container 5102 may be composed of any water-proof material such as plastic, ceramic, glass, or metal.

In the operation of the example agitator 1506 in FIG. 15, the user shakes the liquid container 1502. The agitator 1506 moves vertically inside the container 1502 roughly along a vertical axis 1540 when the container 102 is held substantially upright and spins from the impact of the liquid on the blades thereby agitating the liquid in the container 1502. The agitator 1506 allows the mixing of the liquid with the powder or other types of additives through agitation of the liquid and the additives. The agitator 1506 may be fabricated with suitable materials such as plastics, metals, composites, woods, rubber, or silicone.

Figure 16A:
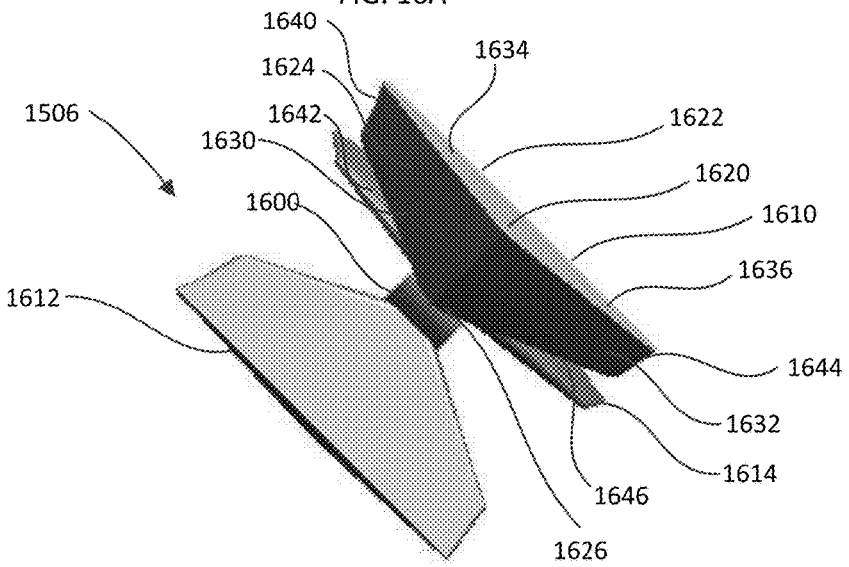
FIG. 16A is a perspective view of the triple bladed agitator shown in FIG. 15.
Figure 16B:
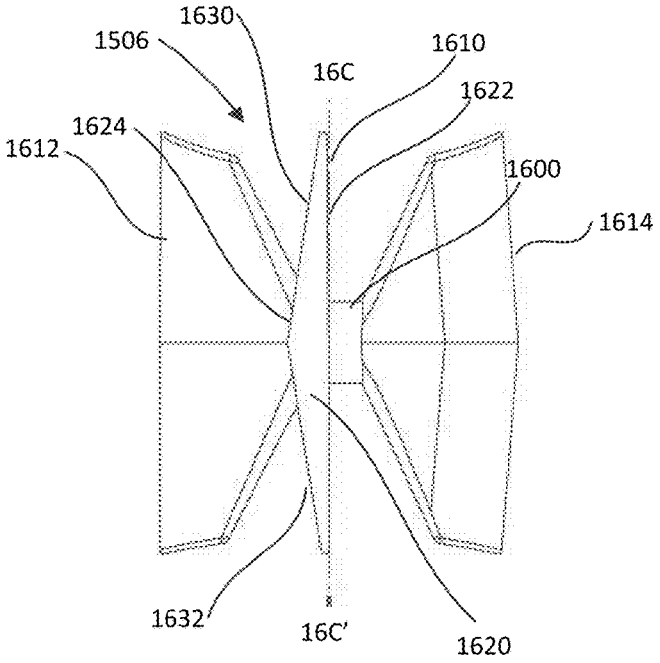
FIG. 16B is a side view of the triple bladed agitator shown in FIG. 15.
Figure 16C:
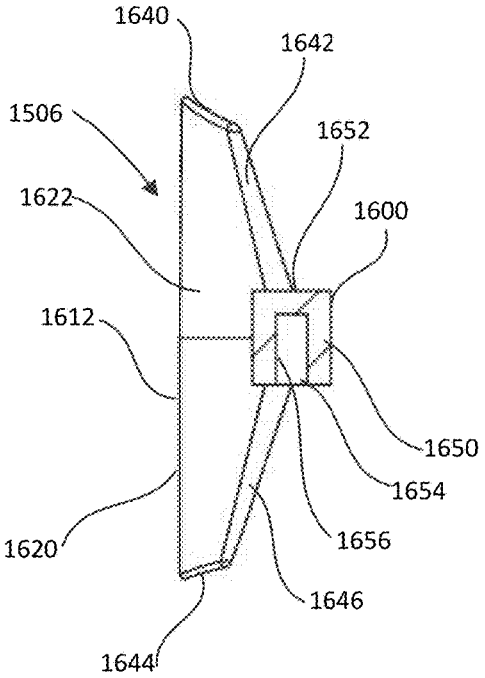
FIG. 16C is a cutaway view along line 16C-16C' in FIG. 16B.
Figure 16D:
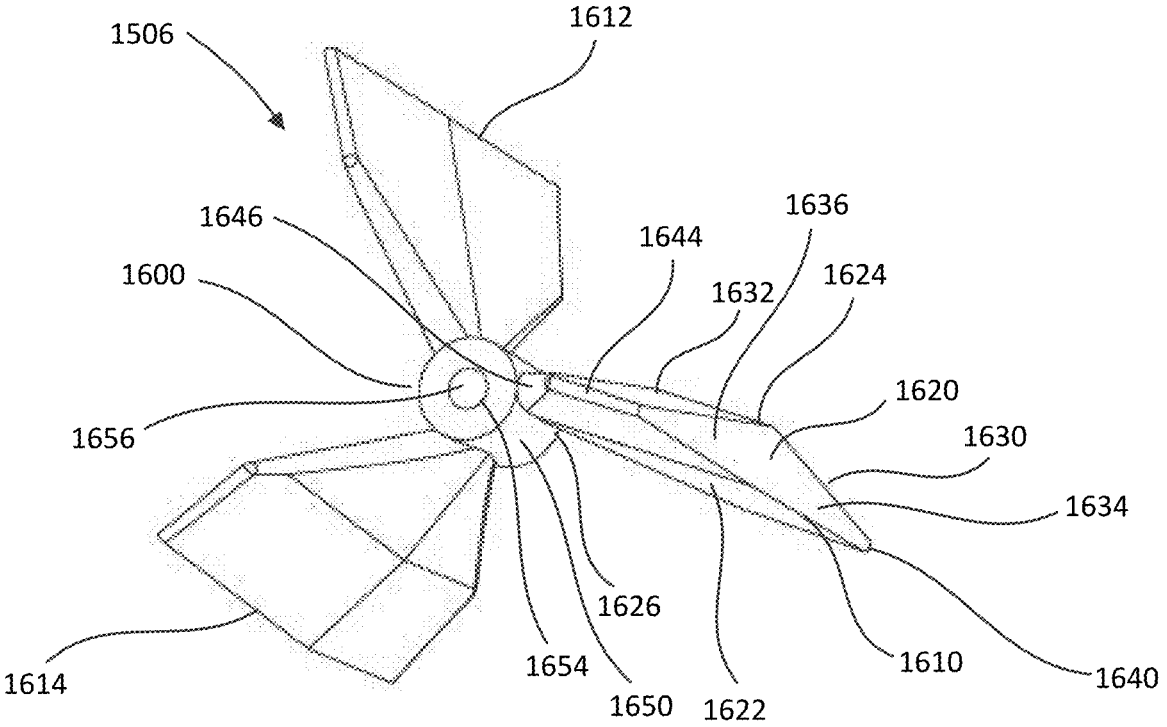
FIG. 16D is a top perspective view of the agitator in FIG. 16A.
Figure 16E:
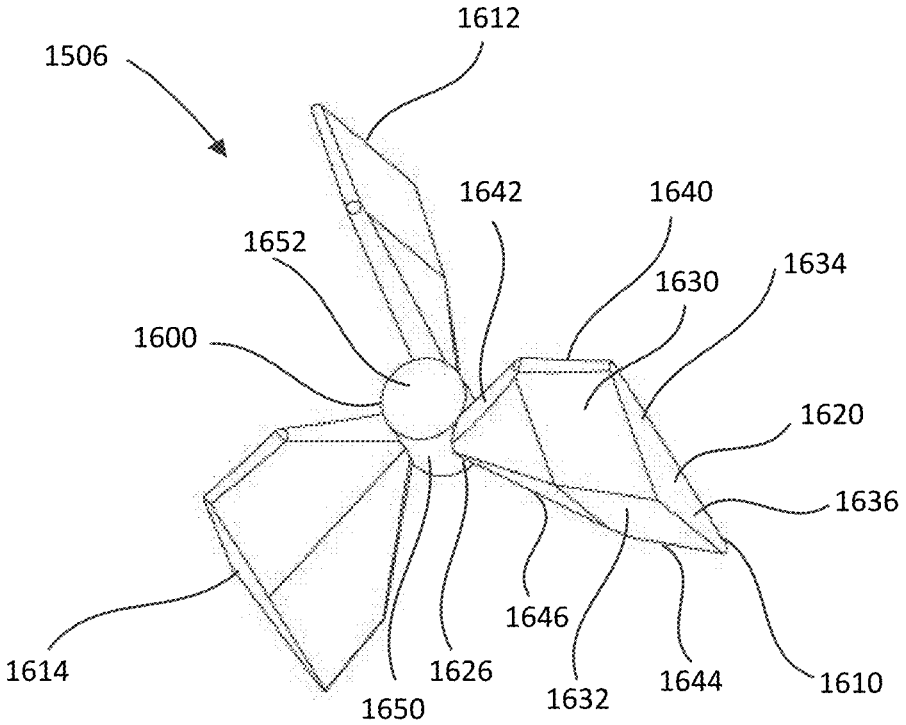
FIG. 16E is a bottom perspective view of the agitator in FIG. 16A.
Figure 16F:
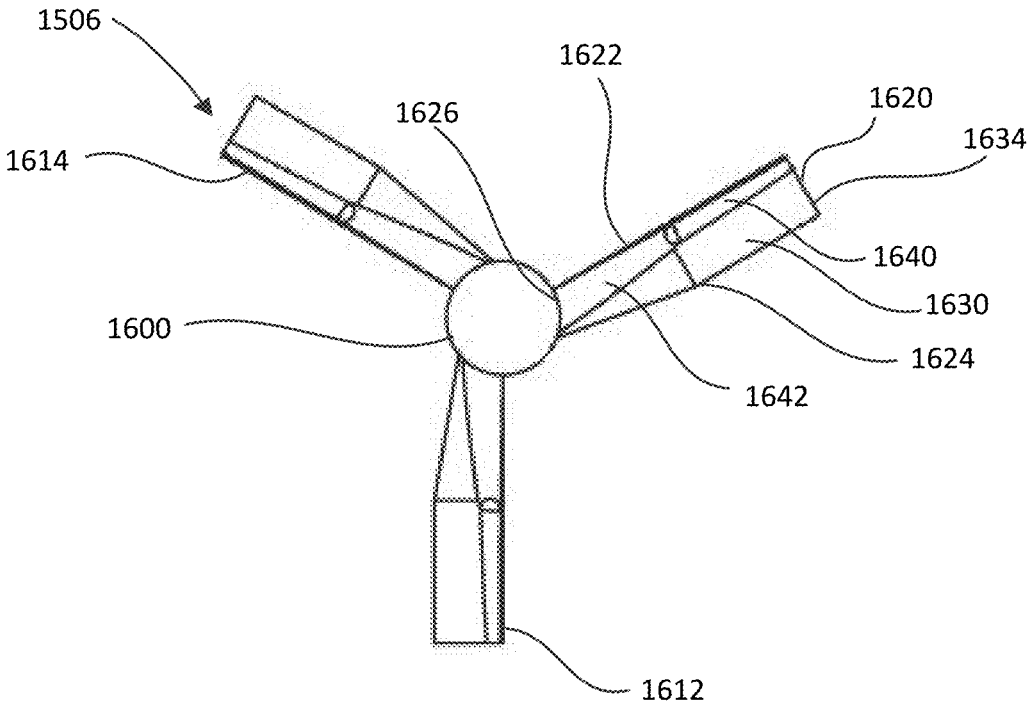
FIG. 16F is a top view of the agitator in FIG. 16A.
Figure 16G:
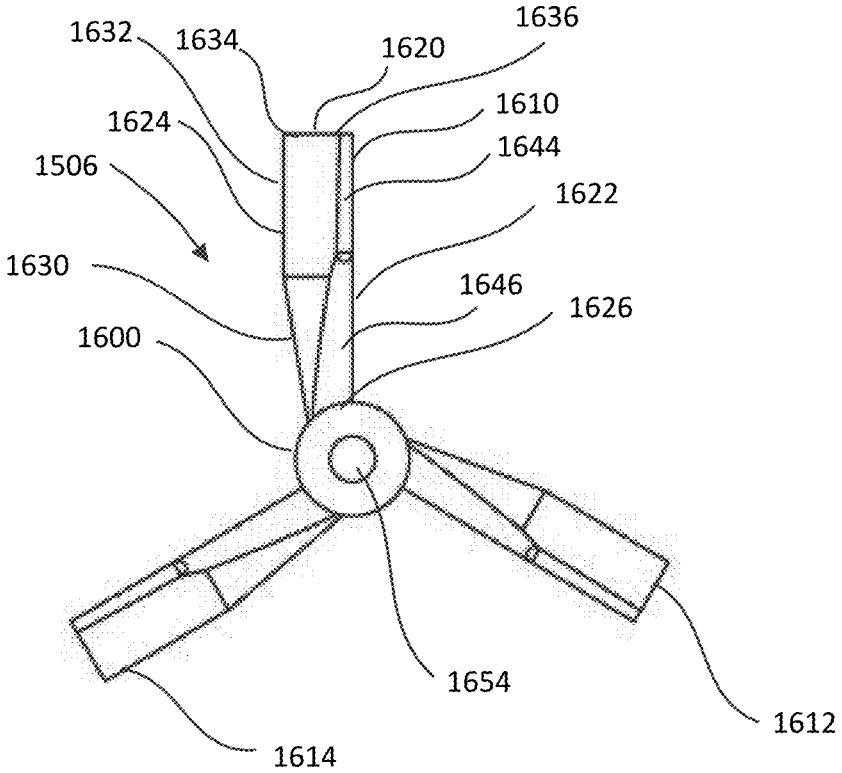
FIG. 16G is a bottom view of the agitator in FIG. 16A.

FIGS. 16A-16G are different views of the triple bladed agitator 1506 in FIG. 15. FIG. 16A is a perspective view of the triple bladed agitator shown in FIG. 15. FIG. 16B is a side view of the triple bladed agitator 1506. FIG. 16C is a cutaway side view along line 16C-16C' in the triple bladed agitator 1506 in FIG. 16B. FIG. 16D is a top perspective view of the agitator 1506 in FIG. 16A. FIG. 16E is a bottom perspective view of the agitator 1506 in FIG. 16A. FIG. 16F is a top view of the agitator in FIG. 16A. FIG. 16G is a bottom view of the agitator in FIG. 16A.

The agitator 1506 includes a cylindrical main body 1600. The main body 1600 supports three blades 1610, 1612, and 1614. The blades 1610, 1612, and 1614 are identical in shape in this example. In this example, the blades 1610, 1612, and 1614 are spaced equally radially from each other on the cylindrical main body 1600. In the following figures, each of the blades have identical components that will be described in reference to the blade 1610.

As shown in FIG. 16B, each of the blades such as the blade 1610 have a triangular cross-sectional shaped outer edge 1620. Each blade, such as the blade 1610, has two opposite sides 1622 and 1624. The blade 1610 includes an inner proximal end 1626 that is attached to the main body 1600. One of the sides 1622 is largely flat and defines one of the sides of the triangular shaped outer edge 1620. The other side 1624 is formed by two sloped surfaces 1630 and 1632 that each define the other two sides of the triangular shaped outer edge 1620. The surface of the outer edge 1620 is composed of two sloped surfaces 1634 and 1636 that are joined.

Each blade such as the blade 1610 has a two section top section having a distal portion 1640, and a proximal portion 1642 that defines an angle projecting from the surface of the central cylinder 1600. The proximal portion 1642 is also located at an angle from one end of the distal portion 1640. The other end of the distal portion 1640 is joined to the outer edge 1620. Each blade such as the blade 1610 has two-piece bottom section having a distal portion 1644 and a proximal portion 1646 that defines an angle projecting from the surface of the central cylinder 1600. The proximal portion 1646 is also located at an angle from one end of the distal portion 1644. The other end of the distal portions 1644 is joined to the outer edge 1620. In this example, the top section and the bottom section of the blade 1610 are symmetrical.

The cylindrical central body 1600 includes a cylindrical outer surface 1650. The central body 1600 includes a closed end 1652 and an opposite open end 1654. An inner surface 1656 is accessible from the open end 1654.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A physically independent agitator for insertion in a container holding liquid, the container including a top mouth, a body containing the liquid and a closed bottom end; the agitator comprising:

a central body having a top and a bottom, the central body having sufficient density to be immersed in the liquid in the container;

a plurality of blades supported by the body, each of the blades having a proximal end attached to the body, a first side having a flat surface, a second opposite side having a first surface sloped relative to the flat surface, and a second surface sloped relative to the flat surface and a distal outer edge having a triangular cross section, wherein the triangular cross section is defined by the flat surface, and the sloped first and second surfaces, wherein each of the blades includes a top section and a bottom section defined by the triangular cross section, and wherein the height of each of the blades between the top section and the bottom section is greater than the height of the central body between the top and the bottom of the central body, wherein the blades and the central body are insertable through the top mouth of the container, and wherein the blades are propelled by the liquid to cause the agitator to spin when the container is shaken.

2. The agitator of claim 1, wherein there are three blades.

3. The agitator of claim 2, wherein the three blades are positioned radially equidistant from each other on the body.

4. The agitator of claim 1, wherein the central body has a cylindrical shape.

5. The agitator of claim 1, wherein each of the blades include a top section and a bottom section, wherein the top and bottom sections are symmetrical.

6. The agitator of claim 5, wherein the top section of each blade includes an angled proximal portion and a second angled distal portion ending in the distal edge.

7. The agitator of claim 1, wherein at least one of a center of gravity, a center of buoyancy or a material density are selected to stabilize the agitator in the liquid.

8. The agitator of claim 1, wherein the agitator is constructed of at least one of a plastic, a metal, a wood, a silicone or a rubber material.

9. The agitator of claim 1, wherein the central body spins along a vertical axis when the container is shaken, and wherein the flat surface of each of the blades is parallel to the vertical axis.

10. A liquid agitation system comprising:

a liquid container including a closed bottom, a body holding liquid, and an open mouth;

a lid for removable attachment to the container over the open mouth;

a physically independent agitator in the liquid container, the physically independent agitator including a body having sufficient density to be submerged in the liquid in the container and a plurality of blades supported by the body, wherein the agitator is insertable into the liquid container through the open mouth, each of the blades having a proximal end attached to the body, a first side having a flat surface, a second opposite side having a first surface sloped relative to the flat surface and a second surface sloped relative to the flat surface, and a distal outer edge having a triangular cross section, wherein the triangular cross section is defined by the flat surface, and the sloped first and second surfaces, wherein the blades are propelled by the liquid to cause the agitator to spin when the container is shaken.

11. The liquid agitation system of claim 10, wherein the agitator has three blades.

12. The liquid agitation system of claim 11, wherein the three blades are positioned radially equidistant from each other on the body.

13. The liquid agitation system of claim 10, wherein the central body has a cylindrical shape.

14. The liquid agitation system of claim 10, wherein each of the blades include a top section and a bottom section, wherein the top and bottom sections are symmetrical.

15. The liquid agitation system of claim 14, wherein the top section of each blade includes an angled proximal portion and a second angled distal portion ending in the distal edge.

16. The liquid agitation system of claim 10, wherein at least one of a center of gravity, a center of buoyancy or a material density are selected to stabilize the agitator in the liquid.

17. The liquid agitation system of claim 10, wherein the agitator is constructed of at least one of a plastic, a metal, a wood, a silicone or a rubber material.

18. A physically independent agitator for insertion in a container holding liquid, the agitator comprising:

a central body having sufficient density to be immersed in the liquid in the container, the central body including a top and a bottom;

a plurality of blades supported by the body, each of the blades having a proximal end attached to the body, a first side having a flat surface, a second opposite side having a first surface sloped relative to the flat surface, and a second surface sloped relative to the flat surface and a distal outer edge having a triangular cross section, and a top section and a bottom section defined by the triangular cross section, wherein the triangular cross section is defined by the flat surface, and the sloped first and second surfaces, wherein the blades are propelled by the liquid to cause the agitator to spin when the container is shaken, and wherein the height of each of the blades between the top section and the bottom section is greater than the height of the central body between the top and the bottom of the central body.

* * * * *